United States Patent [19]

Sutelan

[11] 4,098,039

[45] Jul. 4, 1978

[54] MULTI-LEVEL BUILDING WITH PREFABRICATED TRIANGULAR CANTILEVER UNITS

[76] Inventor: Franklin S. Sutelan, 301 E. 53rd #3A, New York, N.Y. 10022

[21] Appl. No.: 739,474

[22] Filed: Nov. 8, 1976

Related U.S. Application Data

[60] Division of Ser. No. 654,538, Feb. 2, 1976, Pat. No. 4,035,973, which is a continuation of Ser. No. 507,992, Sep. 20, 1974, abandoned.

[51] Int. Cl.[2] ..... E04B 1/32; E04H 1/04

[52] U.S. Cl. ..... 52/73; 52/236.1; 52/236.3

[58] Field of Search ..... 52/73, 262, 263, 264, 52/201, 236.1, 236.3, 236.7, DIG. 10, 79.4, 79.6

[56] References Cited

U.S. PATENT DOCUMENTS

| | | | |
|---|---|---|---|
| 3,226,889 | 1/1966 | Debes | 52/73 X |
| 3,255,990 | 6/1966 | Williams | 52/73 X |
| 3,452,493 | 7/1969 | Mims | 52/73 |
| 3,487,597 | 1/1970 | Gutt | 52/73 |
| 3,500,601 | 3/1970 | Hamill | 52/263 X |
| 3,710,528 | 1/1973 | Riedberger et al. | 52/236.1 |
| 3,789,560 | 2/1974 | Wood | 52/236.1 |

OTHER PUBLICATIONS

Engineering News Record, Mar. 21, 1963, p. 67, "Overhang Enhance Scenic View".

*Primary Examiner*—Leslie Braun
*Attorney, Agent, or Firm*—Brumbaugh, Graves, Donohue & Raymond

[57] ABSTRACT

A bisectional architectural structure, suitable for residential, commercial or megastructural use, divides interfloor space into separate functional zones, and systematically orients major floor levels according to the axii of two separate structural grid systems which bisect each other in every dimension. As an apartment building or the like, it may comprise a plurality of vertical modules arranged one on top of the other about a common vertical utility core. Each module includes four floors which are accessible from the utility core by a corkscrew-shaped walkway surrounding the utility core. The utility core is provided with at least two elevators, a first of which has a plurality of door openings for servicing each floor. One or more additional elevators in the core have one door per vertical module.

The bisectional architectural structure is articulated at its periphery by a plurality of "triangular cantilevers," each forming a triangularly shaped extension of at least two successive floors which act, in combination with an integral support truss, as a unitary device in cantilever. As a detached multi-floor structural unit, the triangular cantilever may be prefabricated in such a way as to be originally self-supporting, and then hoisted into place and attached to the building at the construction site as an independent "appendage" to the main building structure.

14 Claims, 42 Drawing Figures

LEVEL 1

LEVEL 2

LEVEL 3

LEVEL 4

MULTI-LEVEL BUILDING WITH PREFABRICATED TRIANGULAR CANTILEVER UNITS

This is a division, of application Ser. No. 654,538 filed Feb. 2, 1976, now U.S. Pat. No. 4,035,973, which, in turn, is a continuation of application Ser. No. 507,992 filed Sept. 20, 1974, now abandoned.

BACKGROUND OF THE INVENTION

The present invention relates to an architectural structure of the type conventionally referred to as a "tower" or "high-rise" building. The structure is especially suitable for use as an apartment building, but this structure and, in particular, the invention embodied therein are not limited to any particular use.

Architectural structures forming conventional housing may be generally characterized, in order of increasing efficiency, as single family houses, "low-rise" apartment (or condominium) buildings and "high-rise" apartment (or condominium) buildings. Of these, the low-rise "garden apartments" are usually found in the country or suburbs whereas the high-rise buildings are normally restricted to the city.

Unless otherwise stated, the term "efficiency" is used in this specification in its broad general sense, and is intended to include (1) the energy requirements for heating and cooling a building and for any other services provided in the building; (2) the energy requirements for transportation between the building and the areas of shopping, work, etc., as well as (3) the cost of construction and maintenance of the building on a per-occupant basis.

It has conventionally been considered preferable to live in a one-family house or in a low-rise building rather than in a high-rise building which has, in the past, been conceived architecturally as a "cellular block." Notwithstanding the high population density in a high-rise building, the living conditions in such an environment are often less personal and social than in a low-rise setting.

SUMMARY OF THE INVENTION

It is a general object of the present invention to provide an architectural structure which combines the efficiency of a high-rise building with the social and physical amenities of a low-rise setting.

It is a particular object of the present invention to provide a vertical column arrangement for supporting a bisectional architectural structure, which facilitates the uniform application of structural components, regardless of orientation.

It is another particular object of the present invention to provide a "triangular cantilever" for an architectural structure, forming a unitary device which acts as a multi-floor truss extension of at least two successive triangularly shaped floors of a building's habitable space, that may be prefabricated and attached to two external columns of a building's main structure.

It is further object of the present invention to provide a utility core for an architectural structure having an elevator system which is considerably more efficient than elevator systems heretofore known.

These objects, as well as other objects which will become apparent in the discussion that follows, are achieved, according to the present invention, by providing a vertical support arrangement for a bisectional architectural structure in which a plurality of supporting columns are arranged at one or more of the points of intersection of the following four square "grids" in a horizontal plane:

(1) A first grid consisting of four parallel straight lines extending in a first direction and spaced apart a given distance 2A, and a second set of four parallel straight lines extending in second direction perpendicular to the first direction and spaced apart the distance 2A;

(2) A second grid consisting of a third set of two parallel straight lines extending in the first direction and spaced apart a distance 2A+2B, and a fourth set of two parallel straight lines extending in the second direction and spaced apart the distance 2A+2B. The lines of the second grid are spaced outward from the innermost lines of the first grid a distance B which is greater than zero and less than the distance 2A but is not equal to the distance A;

(3) A third grid consisting of a fifth set of two parallel straight lines extending in a third direction at a 45° angle with respect to the first direction, and a sixth set of two parallel straight lines extending in a fourth direction perpendicular to the third direction. The lines of the third grid pass through the points at which the innermost lines of the first gird intersect the outermost lines of the first grid; and (4) A fourth grid consisting of a seventh set of two parallel straight lines extending in the third direction at a 45° angle with respect to the first direction, and an eighth set of two parallel straight lines extending in the fourth direction perpendicular to the third direction. The lines of the fourth grid are spaced apart the distance 2A and pass through the points at which the lines of the second grid intersect the innermost lines of the first grid.

In accordance with the present invention there is also provided a vertical module for an architectural structure having a vertical utility core and four planar floor members surrounding the utility core and arranged at four consecutive floor levels. The vertical module is provided with a corkscrew-shaped walkway arranged between the utility core and the planar floor members providing access to as well as common utility rooms for the module.

In accordance with the present invention there is further provided a "triangular cantilever" for an architectural structure having at least two substantially triangular planar floor members arranged one above the other in vertical alignment with their base edges in a common vertical plane, and two support members extending between the two floor members to maintain rigidity and structural support of the cantilevered unit extremities when the triangular cantilever is attached at its base corners to the side of a building. The first support member extends diagonally from the base edge of one of the two floor members to the tip or apex of the lateral edges of the other. The second support member extends substantially vertically between the outer tips of the two floor members.

According to the invention there is further provided a utility core for an architectural structure bounded by a vertical wall or walls forming a vertical core or "tube." The vertical core is divided internally into at least two sections extending substantially its entire length. An elevator is arranged in each one of the two sections to provide, in one case, service to each floor and, in the other, service to successive groups of two or more floors. If desired, the vertical core may also be provided with an emergency stairway in a separate section thereof that has access to each floor.

DESCRIPTION OF THE PREFERRED EMBODIMENTS

Figure 1:
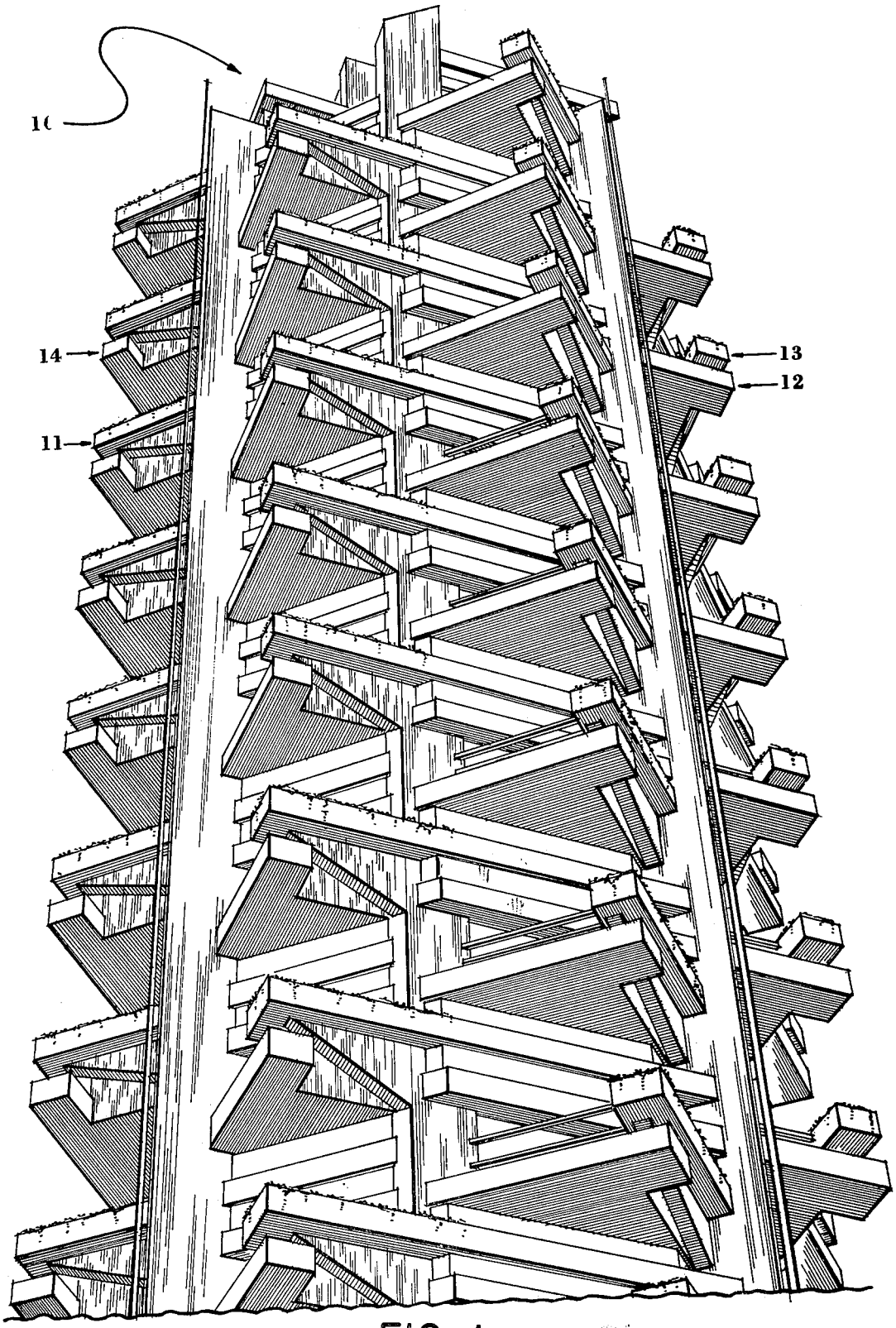
FIG. 1 is a perspective view of the preferred embodiment of an apartment (or condominium) building employing the various principles and features of the present invention.

The preferred embodiments of the present invention will now be described with reference to a particular high-rise building 10 which is shown in FIG. 1. This building has been designed to provide a number of rentable or condominium apartments of various sizes that offer a new type of living environment: a compromise between urban and suburban life styles. This building, which will hereinafter be called a "garden apartment tower," selectively incorporates the advantages of both high-rise and low-rise architecture to provide increased efficiency and an improved living environment.

Figure 2:
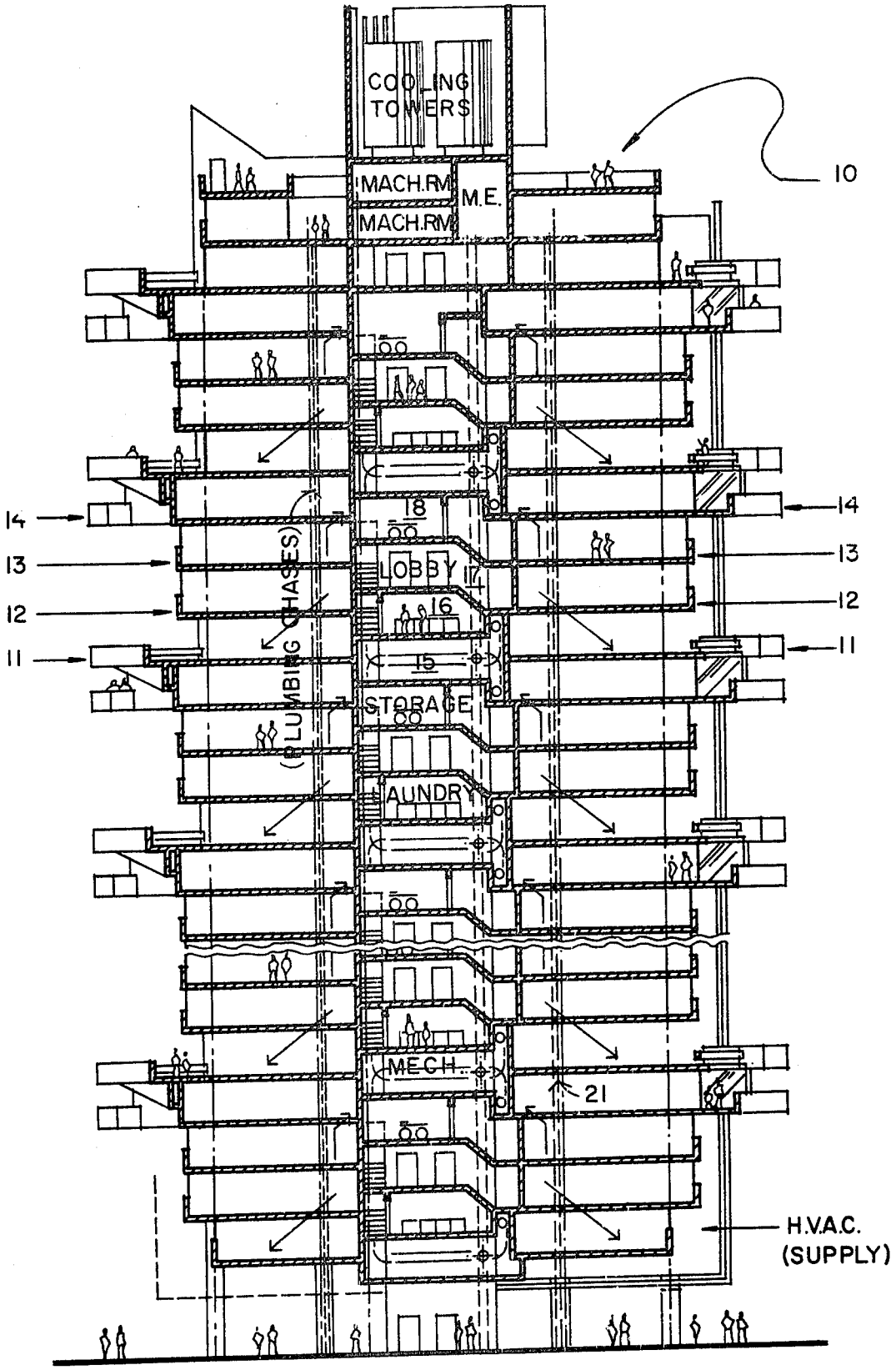
FIG. 2 is a longitudinal sectional view of the building illustrated in FIG. 1, showing the floor, elevator and stair arrangements thereof.
Figure 3:
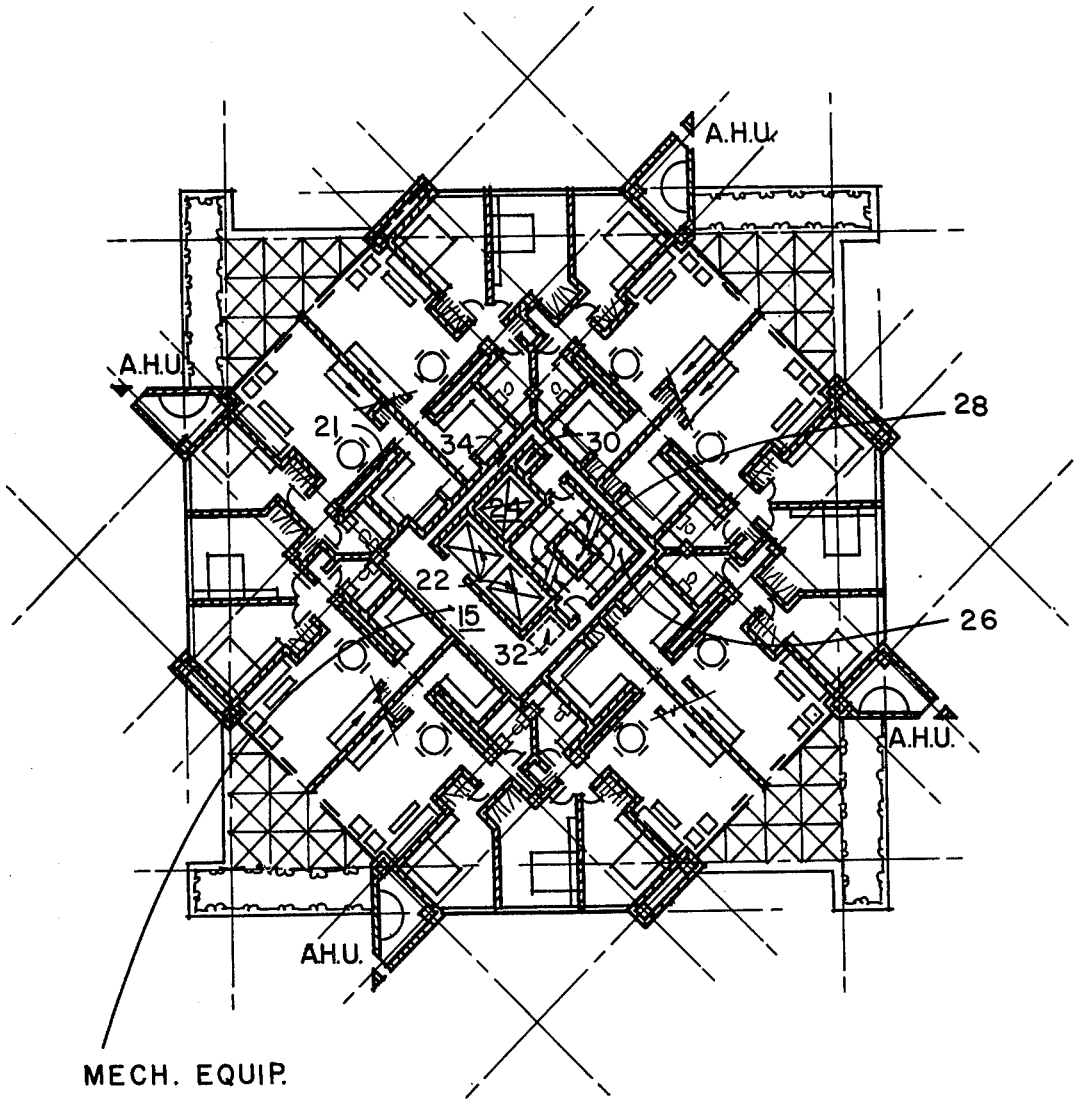
FIGS. 3–6 are horizontal cross-sectional views taken at different levels through the building of FIG. 1, showing how the living space may be divided.
Figure 4:
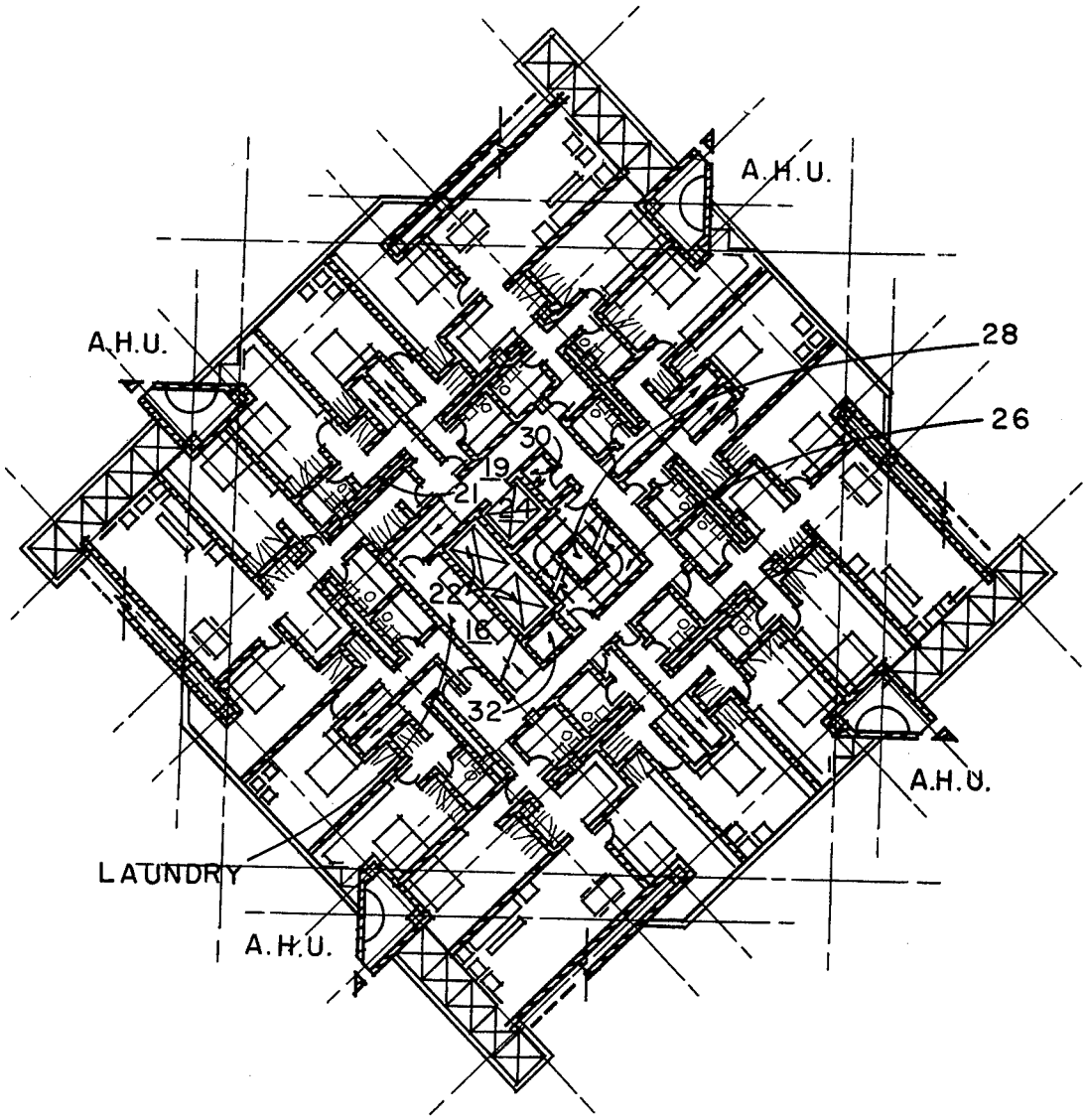
Figure 5:
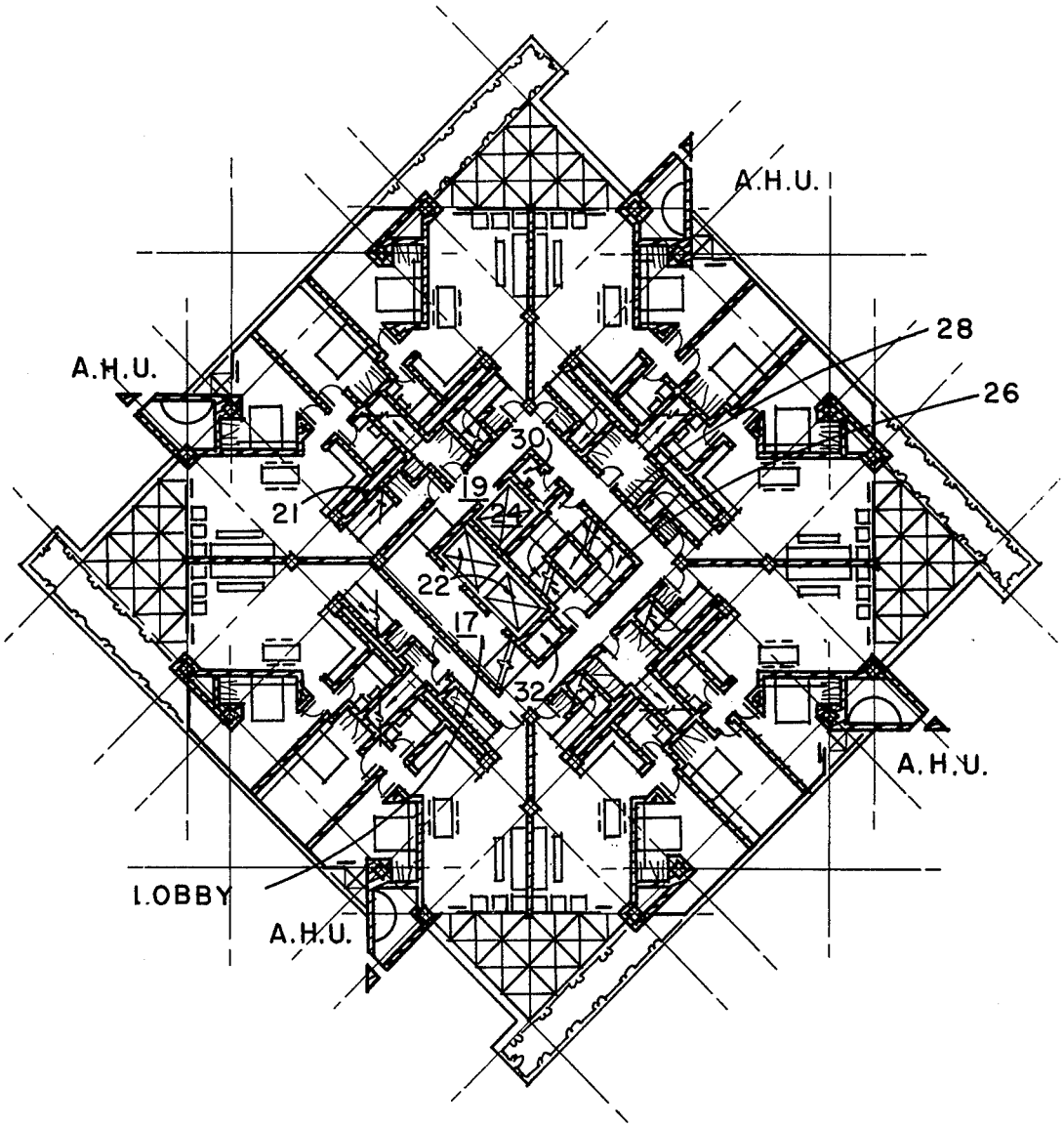
Figure 6:
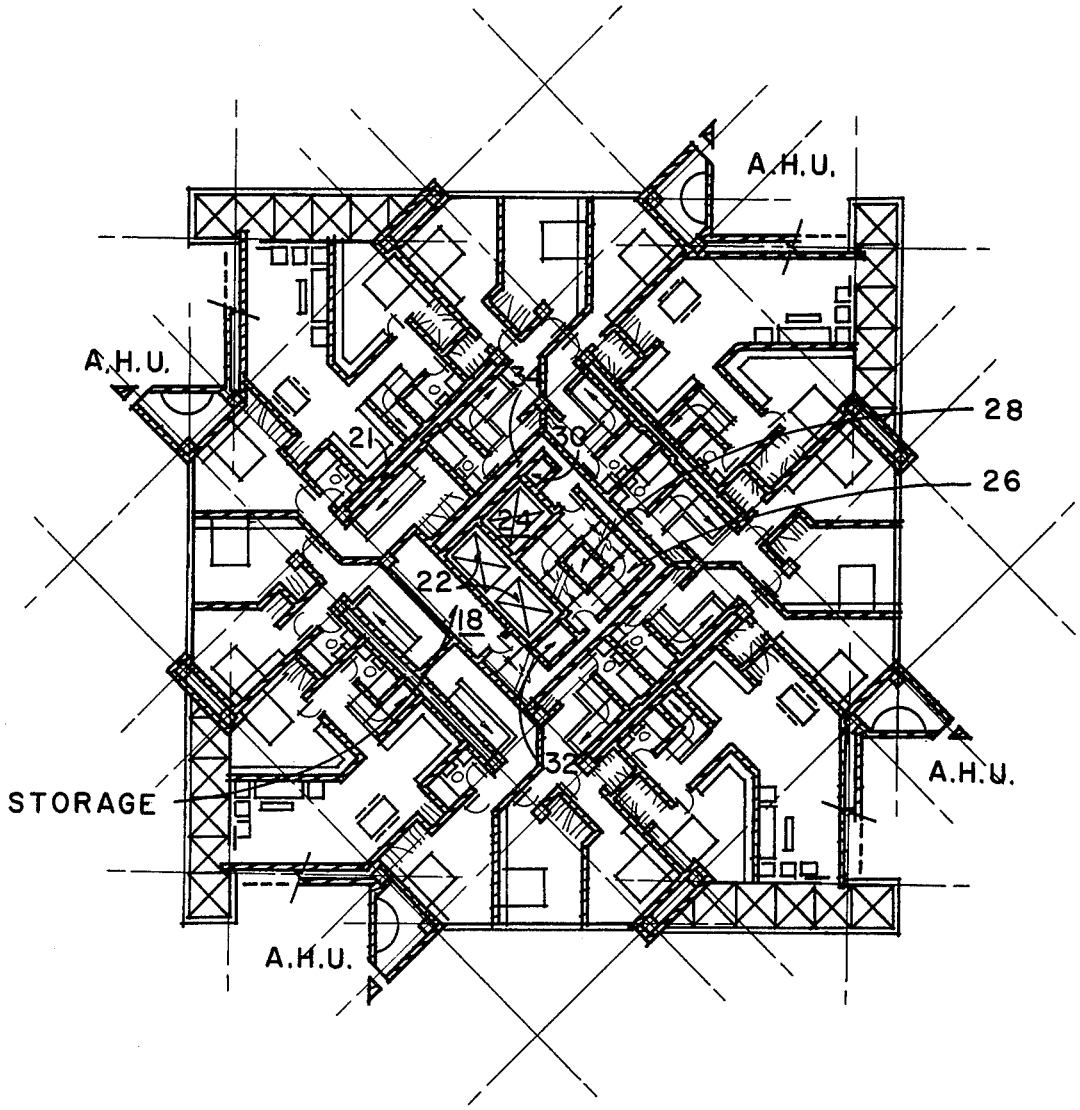

As may best be seen in the longitudinal section constituting FIG. 2, the garden apartment tower 10 comprises a series of 4-story buildings ("vertical modules") stacked on top of each other. Each vertical module has four floor levels which will hereinafter be referred to as level 1, level 2, level 3 and level 4. Typical floor levels 1–4 of one vertical module are designated in FIGS. 1 and 2 by the reference numerals 11, 12, 13 and 14, respectively.

Referring to FIGS. 2–7, it is seen that each vertical module may be divided into 24 apartments (mostly duplex) which share certain common utilities or facilities as will be described hereinafter. In this way, the vertical module reduces social contact in the building down to the density of a suburban street.

The garden apartment tower 10, in particular, has seven vertical modules plus a unique 2-story penthouse accommodating four large apartments. The building therefore has thirty residential floors in addition to the usual ground floor which may, for example, be completely open as shown in FIG. 2.

Figure 7:
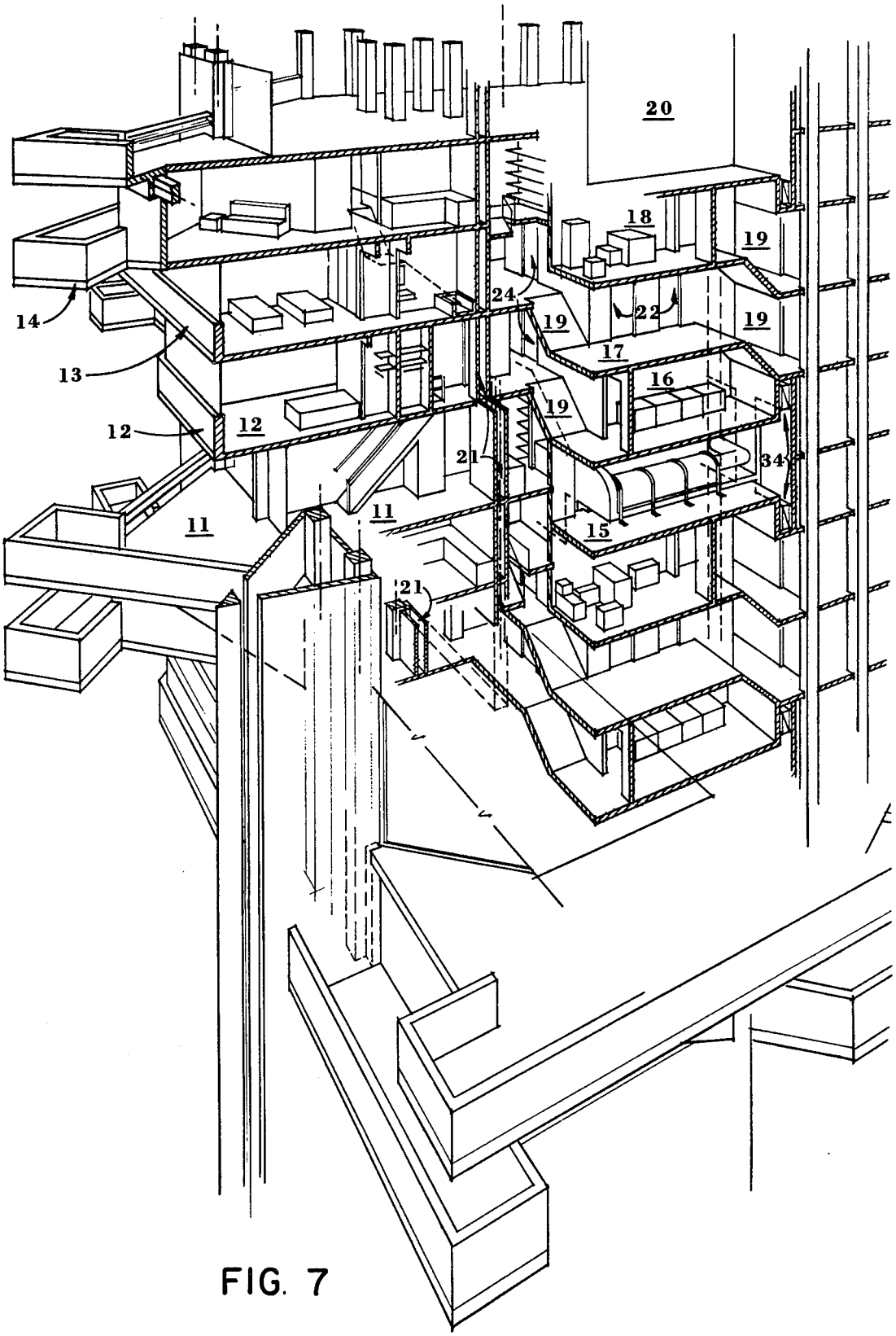
FIG. 7 is a perspective view of the building of FIG. 1 in which portions of the structure have been removed to reveal the internal arrangement thereof.
Figure 8:
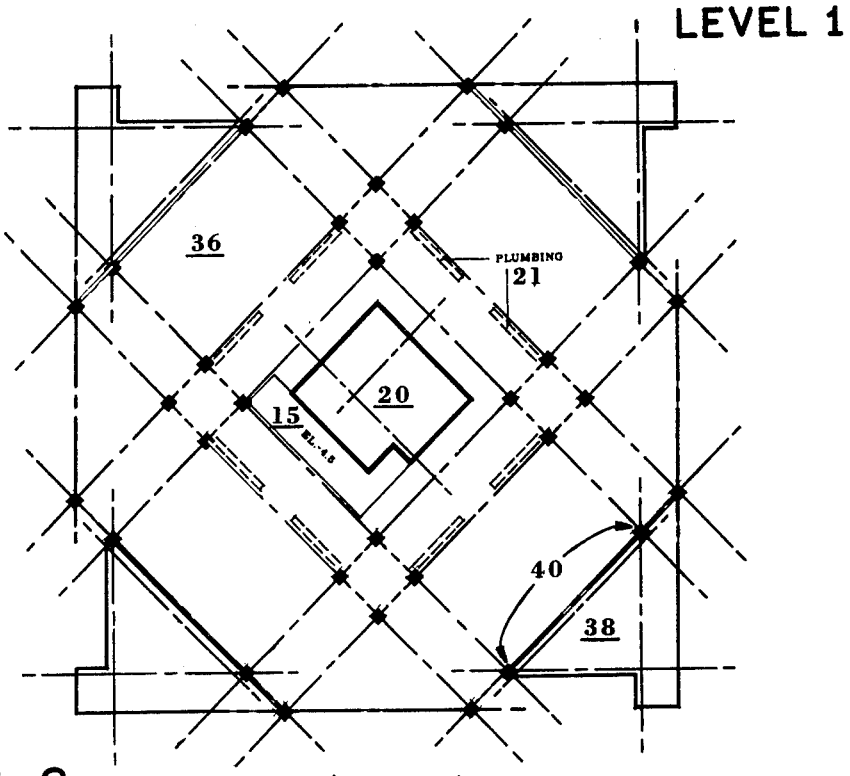
FIGS. 8–11 are representational diagrams showing certain structural components of the building of FIG. 1 at the levels illustrated in FIGS. 3–6, respectively.

Each vertical module of the tower 10 is provided with four common facilities (utilities) at intermediate levels between the floor levels 11, 12, 13 and 14. As is best illustrated in FIGS. 2 and 7, these facilities are a mechanical equipment room 15, a laundry 16, a lobby 17 and a storage room 18. Excepting the mechanical equipment room 15, these common facilities are interconnected by a corkscrew-shaped walkway 19 surrounding the building utility core 20. Since the doors to all of the apartments in the module open into this common walkway 19, the walkway provides access between apartments as well as to the common facilities, thus establishing a social unit. The walkway 19 terminates in its lower extremity at the laundry room 16 and in its upper extremity at the storage room 18. Accordingly, only the building elevators provide normal access between the lobby of one vertical module and the lobby of another.

Plumbing chases 21, running in a continuous vertical plane serve the private utilities of each separate apartment.

As is best illustrated in FIGS. 3–6, the utility core 20 of the building is provided with two passenger elevators 22 having door openings into the lobby 17 of each vertical module. The elevators 22 provide the normal service between the ground floor and each module as well as the interfloor service between modules. Because the passenger elevators 22 are permitted to make only one stop at every four floors of the tower 10, the elevator efficiency is greatly improved, permitting a reduction in the number of elevators that would otherwise be required in a building the size of the tower 10 and/or a reduction in the waiting time for an elevator to stop at any given lobby.

The utility core 20 is also provided with a service elevator 24 having door openings at two or more floors of each vertical module. As is best illustrated in FIG. 7, the service elevator provides direct access to the module floors 12 and 13. This arrangement provides accessibility to all of the apartments due to the corkscrew walkway 19 and because various units are duplex apartments having an internal staircase.

The utility core is further provided with a scissor-type fire stair 26 surrounding an airshaft 28. This scissor-stair arrangement is associated with two door openings at each floor level for access to each separate fire stair. In addition, the utility core 20 has an incinerator shaft 30 which is accessible at two levels of each module from the walkway 19.

Finally, the utility core is provided with a shaft 32 extending vertically from the mechanical equipment room of each module for the passage of heating and cooling ducts, and the like. Chase space 34, surrounding the utility core within a maximum of two floor levels, permits distribution of the heating and cooling ducts to every apartment within a maximum of four floor levels.

Compared with a high-rise building having the conventional elevator arrangement in which all elevators have door openings at every floor, the garden apartment tower according to the present invention has 66% fewer openings, doors and landings. By thus eliminating nearly 60 percent of the building's general circulation, the tower could theoretically achieve a gross rentable efficiency of up to 92%.

The incorporation of the mechanical equipment station in each module relieves a sizable burden from the mechanical penthouse equipment, and thus allows more space on the roof for landscaping or other amenities. In addition, efficiencies may be gained through the local distribution of conditioned air. Further, by incorporating the mechanical, laundry and storage areas within the tower (and above the ground), the necessity for the excavation and construction of a basement may be eliminated, thus offsetting the initial cost of the modular mechanical equipment.

Compared to a conventional apartment arrangement in which the apartment doors on each floor open into one or more linear corridors, the corkscrew-shaped walkway 19 results in a reduction in corridor space by a factor of two.

Considering the apartment layout in detail, it may be seen from FIGS. 2–7 that a private stairway (typical in the suburban house) is used in nearly every apartment. Duplex floor plans are rotated to allow each apartment a corner view on one of its two levels, despite an average of six apartments per floor. Small terraces are combined and shared by two apartments creating "penthouse-like" luxury without extra cost. The underlying design premise is that the residents of both apartments would not necessarily use the terrace space at the same time so that, when they are used, they will be more spacious than the conventional individual "postage stamp" balconies and will establish a sense of community not unlike that which is found in a traditional low-rise garden apartment complex.

Assuming the maximum span, between adjacent columns, to be 30 feet (the distance which will hereinafter be designated as the distance "2A"), the vital statistics on the garden apartment tower 10 are as follows:

| | |
|---|---|
| Total tower = 7 vertical modules (V.M.'s) + 2 penthouse (PHS) levels = 30 residential floors. | |
| Gross area per V.M. = 33,945 gross sq. ft. (G.S.F.). | |
| Total gross V.M. area = 33,945 × 7 = 237,615 G.S.F. | |
| Total PHS area = 11,950 G.S.F. | |
| Total residential area = 237,615 + 11,950 = 249,565 G.S.F. | |
| 24 apartments per V.M. × 7 | = 168 units |
| 4 PHS apartments | + 4 units |
| Total separate apartments | = 172 units (Incl. 404 = bedrooms (BR's)). |
| Average BR count per unit | = 2.35 BR's per unit. |
| Average unit sizes: 1 BR | = 932 G.S.F. |
| 2 BR | = 1192 G.S.F. |
| 3 BR | = 1280 G.S.F. |
| 3 PHS | = 2294 G.S.F. |
| Total bldg. population | = 404 BR's at 1.5 persons per BR = 606 people. |
| Population per V.M. per BR). | = 84 people (Incl. 56 BR's at 1.5 persons |

Apartment gross areas at levels one and two:

| 2 BR Nos. | G.S.F. | 3 BR Nos. | G.S.F. |
|---|---|---|---|
| 1 | 1208 | 3 | 1360 |
| 2 | 1162 | 6 | 1360 |
| 4 | 1218 | 9 | 1360 |
| 5 | 1217 | 12 | 1350 |
| 7 | 1218 | | |
| 8 | 1217 | | |
| 10 | 1148 | | |
| 11 | 1162 | | |

Apartment gross areas at levels three and four:

| 1 BR Nos. | G.S.F. | 3 BR Nos. | G.S.F. |
|---|---|---|---|
| 14 | 910 | 13 | 1171 |
| 17 | 967 | 15 | 1327 |
| 20 | 967 | 16 | 1150 |
| 23 | 883 | 18 | 1327 |
| | | 19 | 1150 |
| | | 21 | 1327 |
| | | 22 | 1117 |
| | | 24 | 1342 |

Total apartment variations and exterior situations:

| | |
|---|---|
| 28/ | 1 BR simplex units w/ private balcony |
| 28/ | 2 BR simplex units w/ private balcony |
| 28/ | 2 BR duplex units w/ semi-private terrace |
| 84/ | 3 BR duplex units w/ semi-private terrace |
| + 4/ | 3 BR duplex PHS units w/ private terraces |
| =172 | separate units |

Common facilities per vertical module (i.e., may be eliminated):

| | | |
|---|---|---|
| Laundry | = 117 Sq. Ft. | |
| Mechanical Equipment | = 314 Sq. Ft. | |
| Storage | = +125 Sq. Ft. | |
| Total service areas per V.M. | = 556 Sq. Ft. | |
| Total service areas at mechanical PHS levels | | = 1956 Sq. Ft. |
| Total service areas at 7 V.M.'s (i.e., 556 × 7) | | = +3892 Sq. Ft. |
| Total service areas within tower (above Gr. Fl.) | | = 5848 Sq. Ft. |

It will be understood that the vertical modules of the present invention are not limited to the particular floor plan configuration illustrated in FIGS. 3–6 upon which the statistics set forth above are based. For example, the modules may be provided with predominantly studio and one-bedroom apartments to reduce the average bedroom count per unit.

Figure 9:
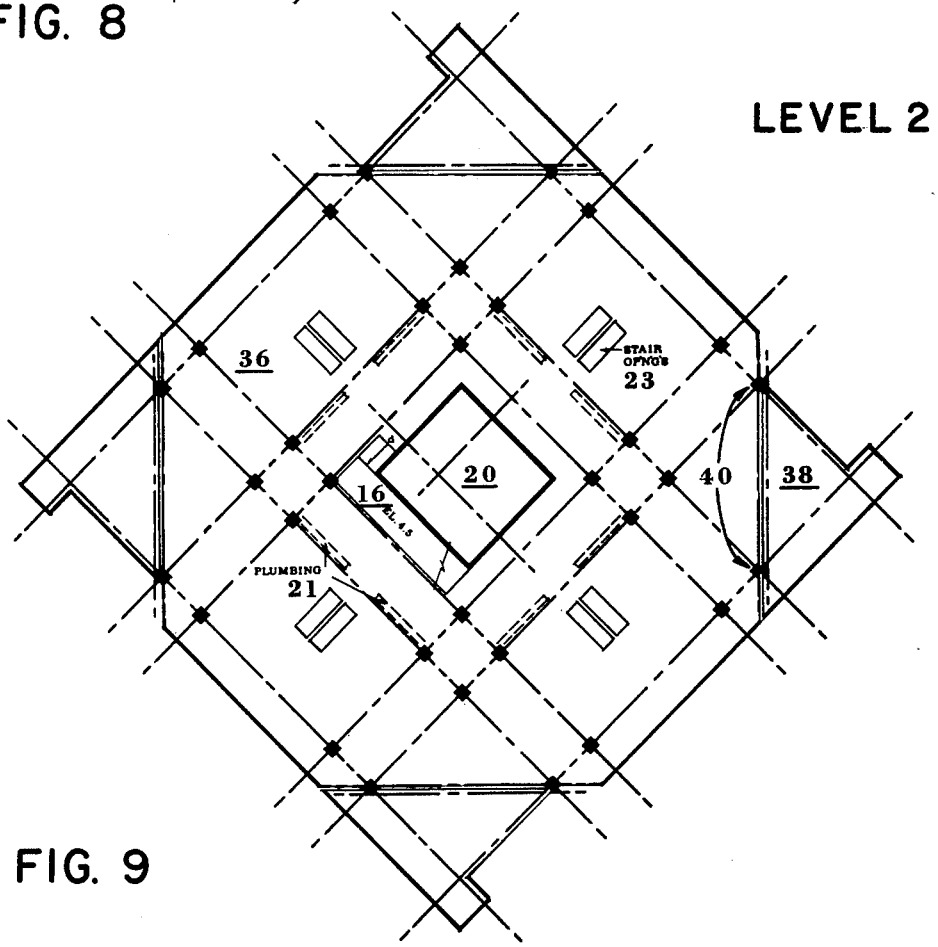
Figure 10:
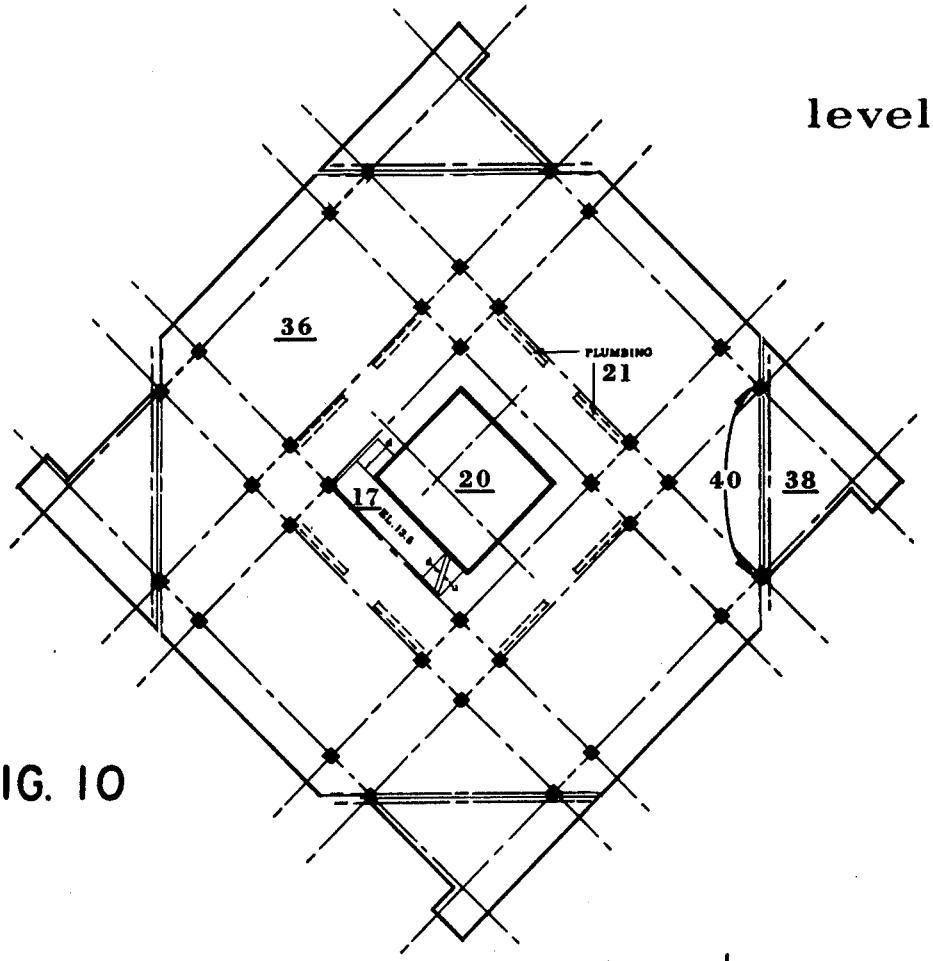
Figure 11:
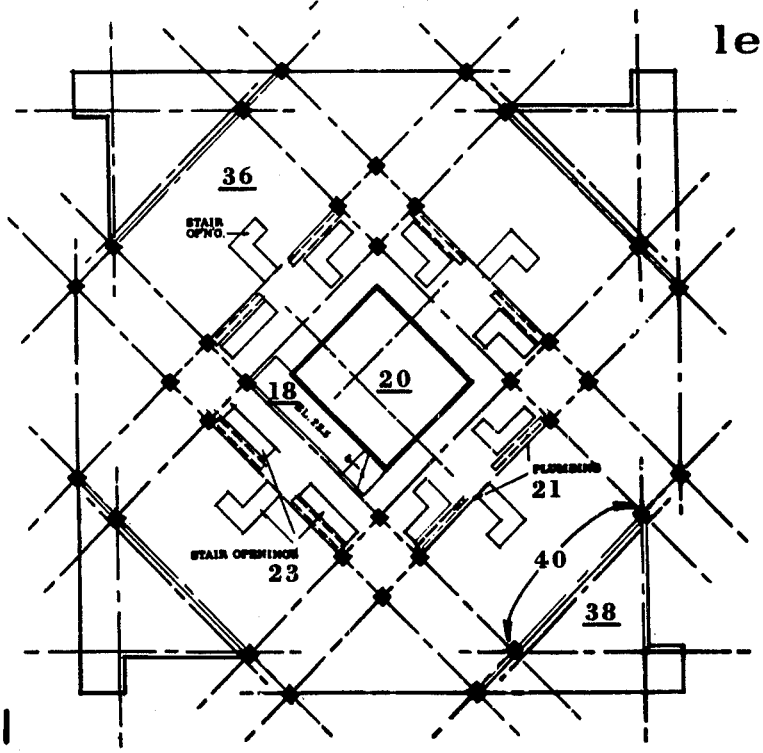

In order for any high-rise building to be economical, its construction must be based on a certain "repetitiveness" of the common elements of each major floor level. FIGS. 8–11 best illustrate how this is achieved in the garden apartment tower 10, corresponding to the levels shown in FIGS. 3–6 respectively. As a tower structure, the building 10 is erected with each major floor 36 octagonally shaped, following the configuration of the tower's column arrangement. Small intermediate levels 15–18 are located directly adjacent to one side of the tower's central utility core 20. Vertical plumbing chases 21 are located in relation to structural beams, and private stair openings 23 in the tower's major floor members are indicated in FIGS. 9 and 11 (i.e., through levels 2 and 4 only). The separate floor members 38, which comprise each level of the triangular cantilever, are identical and may be site-assembled as a unit of two or more floors, lifted intact, and attached into place directly on pairs of structural columns 40 (see FIG. 16). Thus, in the manner of construction described herein and illustrated in FIGS. 8–11, the erection of building 10 adheres to a uniformity which is similar to that of conventionally constructed high-rise buildings, and yet it permits each overall finished floor configuration to appear "rotated" at a 45° angle with other floors.

Figure 12:
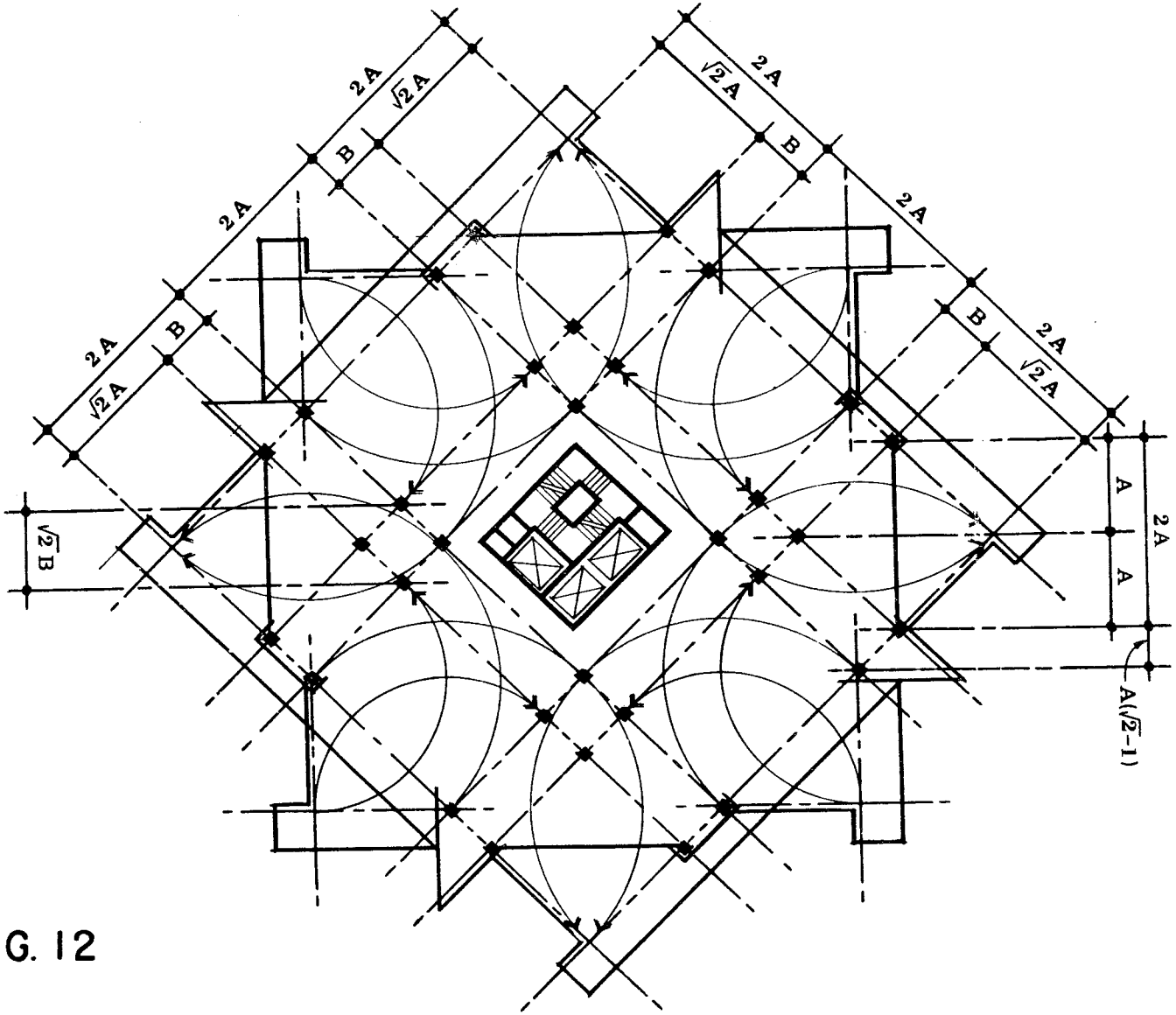
FIGS. 12–14 are representational diagrams illustrating various embodiments of the vertical column arrangement which may be employed in a building of the type illustrated in FIG. 1.
Figure 13:
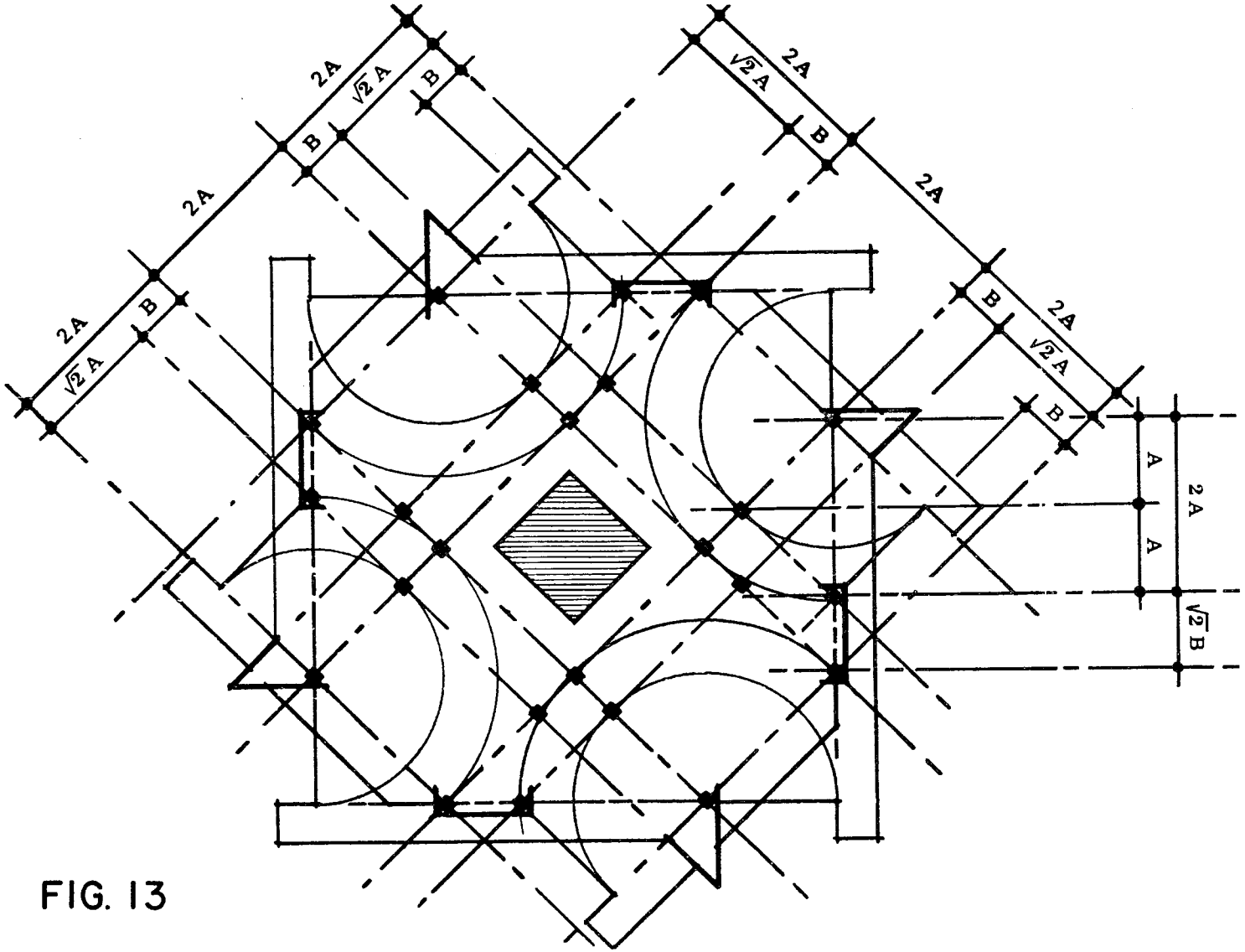

To best explain the functional relationship between these rotated floors and the strategic location of the columns, FIGS. 12 and 13 diagrammatically superimpose levels 1 and 3 (of FIGS. 3 and 5, respectively) to show the origination of a "design formula" which permits the structural components of each triangular cantilever to be identical. This formula is based on the geometric properties of a right triangle. In an isosceles right triangle, by subtracting the length of either leg from the length of the hypotenuse, the resulting distance "B" has been found to have certain advantageous properties which will be described hereinbelow.

In the example illustrated in FIG. 12, in a tower structure where the columns are arranged in the configuration of a "Greek Cross" (formed by the lines of a first square grid which are spaced apart a given distance 2A), additional supportive columns may be located at the points of intersection of the lines of a second square grid (spaced apart a given distance 2A+2B) with the lines of the first square grid. In such manner, the distance 2A of the first grid can also be defined as the linear distance between pairs of these additional supportive columns on the tower's periphery. This distance 2A thus forms the hypotenuse of each isosceles right triangle permitting triangular cantilevers to be identical. As a consequence, all structural components on the periphery of the building can be "standardized." The column arrangement shown in FIG. 12 is utilized in each of the floor levels illustrated in FIGS. 3–6.

Referring to the column arrangement shown in FIG. 13, note that with the same structural grids, eight columns are eliminated from the arrangement shown in FIG. 12, and four other columns are relocated along the structural axii of a third square grid (the lines of which are oriented at a 45° angle to the first and second grids). Notwithstanding these differences, all of the triangular cantilevers remain identical. Thus, the column arrangement in FIG. 13 may be used as an alternate supportive structure to suit different program requirements, and/or to facilitate further construction economies.

Figure 14A:
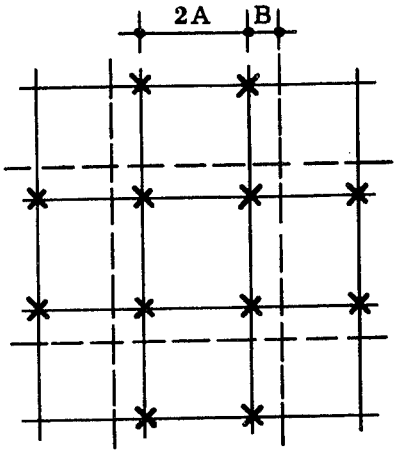
Figure 14B:
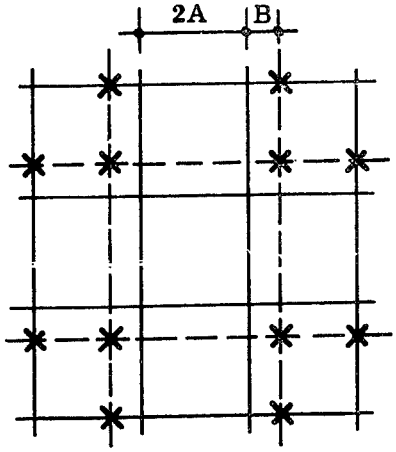
Figure 14C:
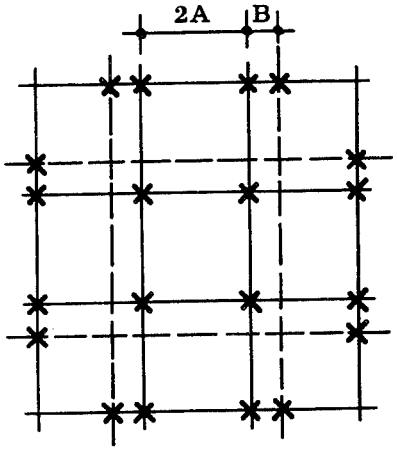
Figure 14D:
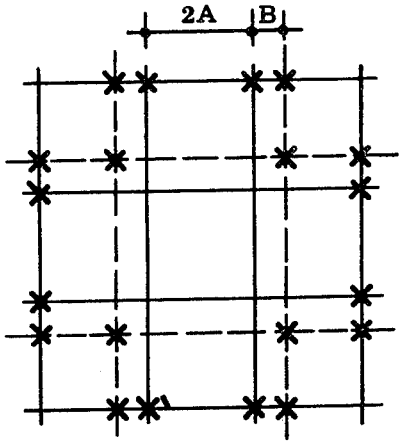
Figure 14E:
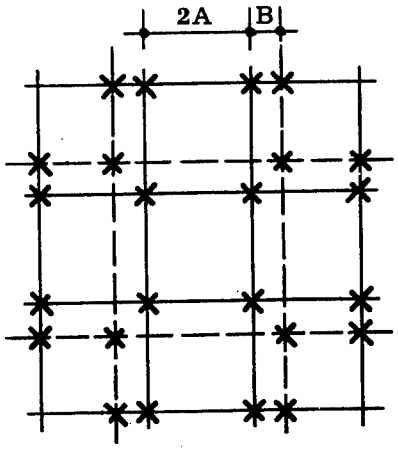
Figure 14F:
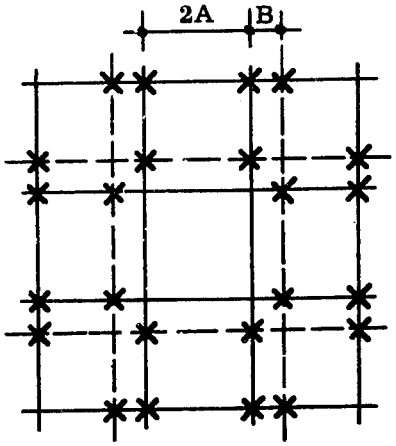
Figure 14G:
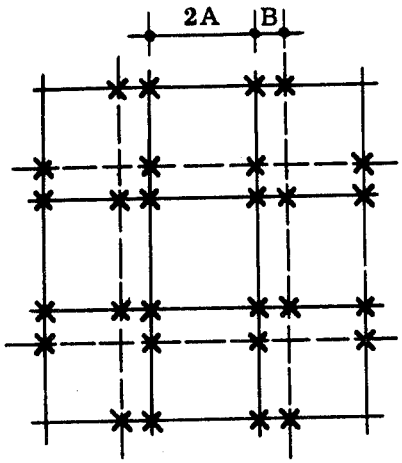
Figure 14H:
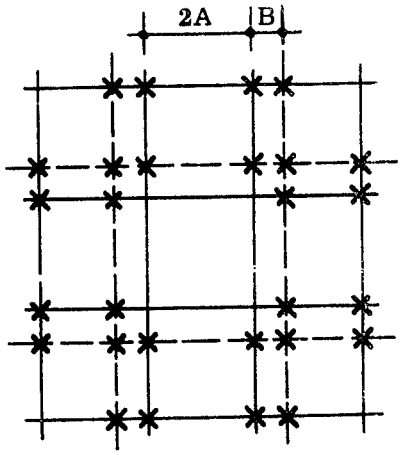
Figure 14I:
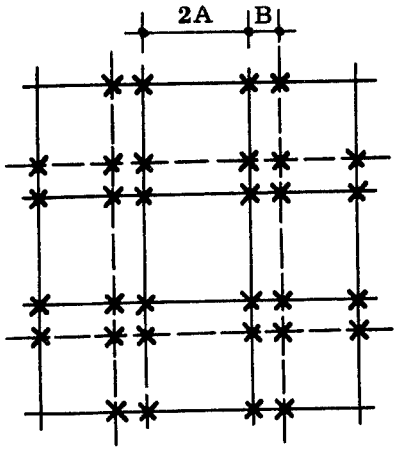
Figure 14J:
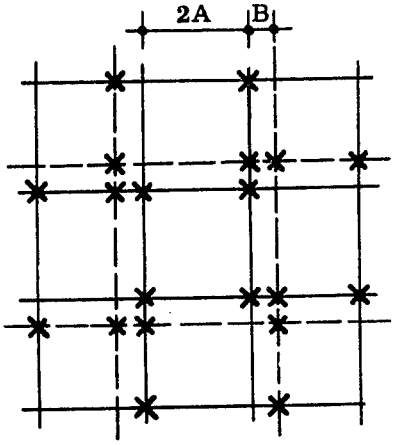
Figure 14K:
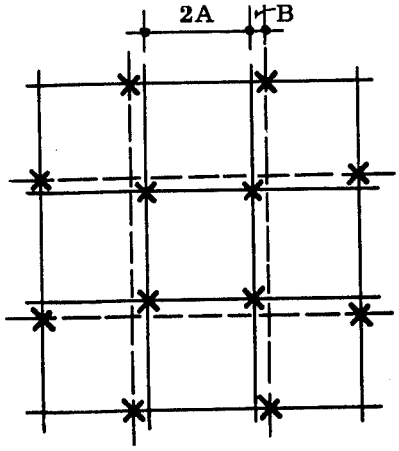
Figure 14L:
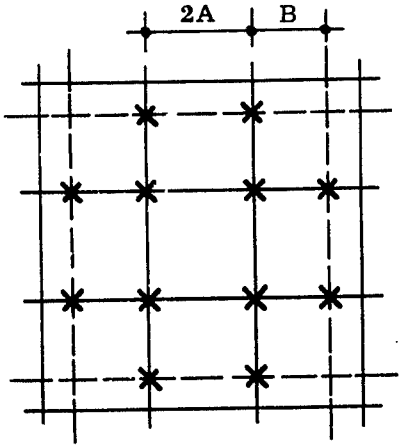

Similarly, other alternate column arrangements may be utilized, as is diagrammatically illustrated in FIGS. **14*a*–14*r*. In each diagram, graphically, the lines of the first square grid are drawn as solid lines; the lines of the second square grid are drawn as a series of dashes; and the lines of a third and fourth square grids are drawn as a series of dashes oriented at a 45° angle with the lines of the first and second grids. Note that in FIGS. 12 and 13 columns are indicated as solid black squares, whereas in FIGS. 14*a*–14*r*** each column is located with an "*x*." The spacing of the first and fourth grid lines, the distance 2A, and the relationship between the first and second grids, the specified distance "B," are noted in each illustration. FIG. 12 and FIGS. **14*a*–14*l* utilize the first and second grid lines only. In FIG. 13 and FIGS. 14*m*–14*q*, the first, second and third grid lines are utilized. And in FIG. 14*r***, the first, second and fourth grid lines are utilized for column locations.

It will be noted, from a consideration of FIGS. 12, 13 and FIGS. **14*a*–14*r***, that there is symmetry in the columnar arrangements, according to the present invention, such that each specific arrangement remains the same no matter from which direction the architectural structure is viewed. In particular, it may be seen that the columns are arranged in corresponding positions in each of four quadrants defined by the medial axes of the first and second grids. Thus, if these grids were rotated about their centers by 90°, the respective columnar arrangements would appear unchanged.

Figure 14M:
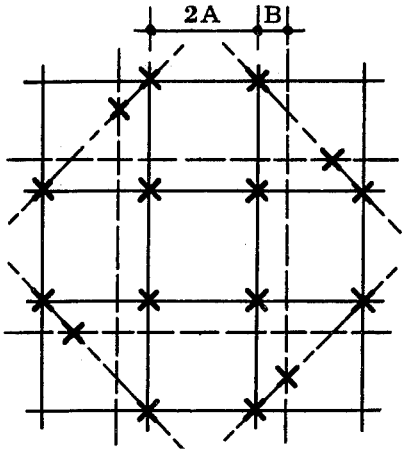
Figure 14N:
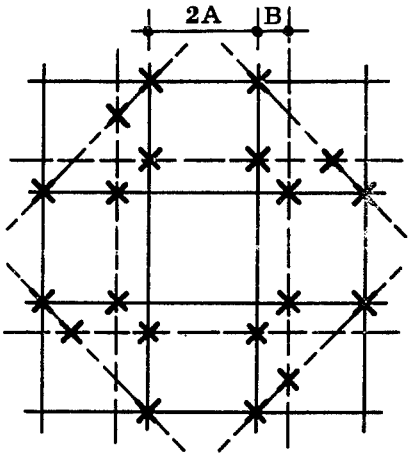
Figure 14O:
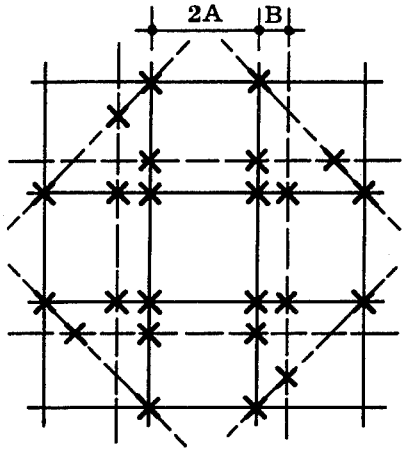
Figure 14P:
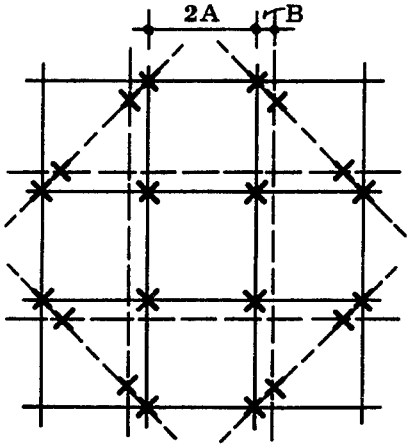
Figure 14Q:
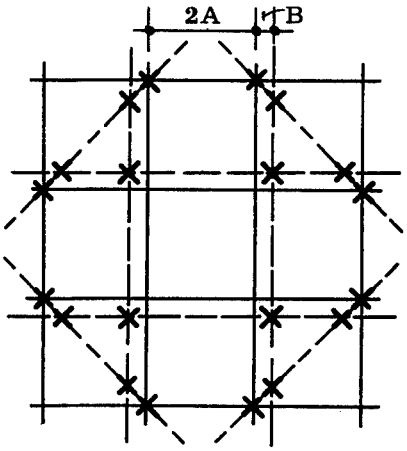
Figure 14R:
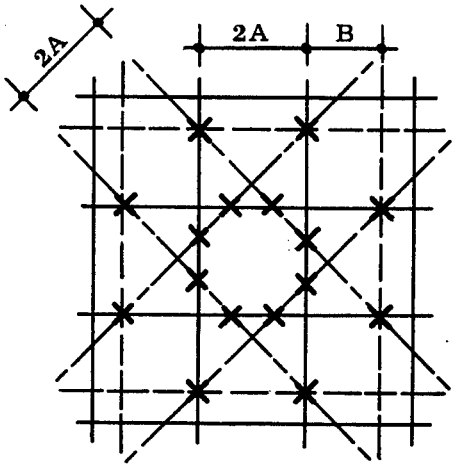

In accordance with the original design formula of FIG. 12, many variations of the distance B have been developed so that adjacent columns on the periphery of the columnar arrangement from a plurality of equal spans along lines which are both parallel and oblique to the lines of the first and second square grids. This permits the structural components of each triangular cantilever on the periphery of the building, which are supported by the columnar arrangement, to be the same. Thus, for an optimal arrangement of structural columns (as per illustrated), it may be ascertained that the distance B is related to the distance A according to the formula:

In FIGS. **12–14*i*, and FIGS. 14*m*–14*o***, $$B = A\,(2 - \sqrt{2});$$

In FIG. **14*j***, $$B = A/2;$$

In FIG. **14*k***, $$B = A\,(3\sqrt{2} - 4);$$

In FIGS. **14*l* and 14*r***, $$B = \sqrt{2}\,A;$$

and, in FIGS. **14*p* and 14*q***, $$B = A\,(1 - (\sqrt{2}/2).$$

Figure 15:
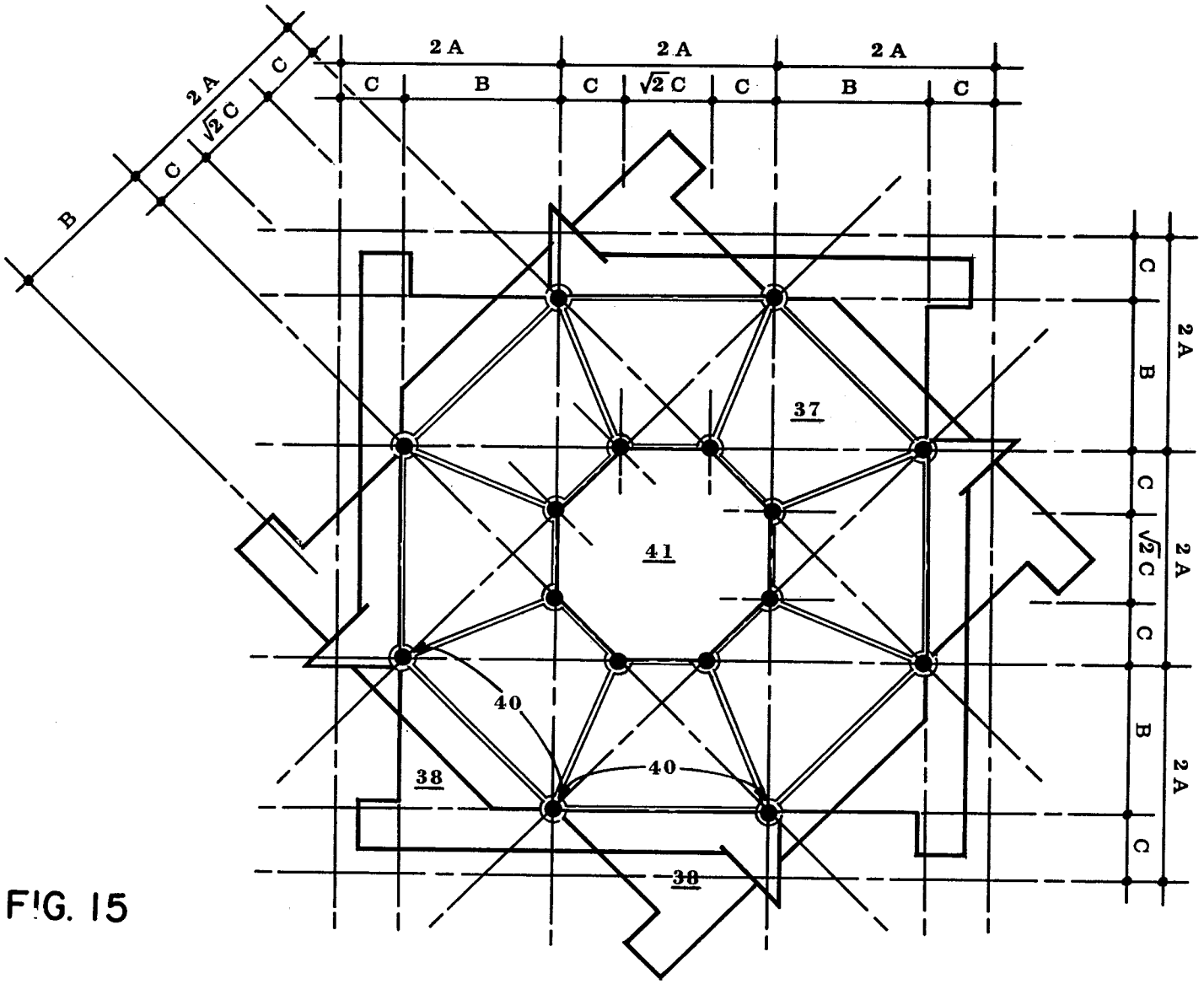
FIG. 15 is a representational diagram showing the modular benefits of the particular column arrangement shown in FIG. 14*r*.

As can best be seen in FIG. 15, and in reference to the particular column arrangement shown in FIG. **14*r*, it can be seen that perfect octagonal shapes are formed by the eight innermost as well as by the eight outermost columns. Furthermore, the location of each of the innermost columns coincides with lines radiating from the overall structure's center point to each respective outermost column. Thus, the entire area between the innermost and outermost columns can be subdivided into eight separate and identical, trapezoidal floor members 37 for purposes of prefabrication. When utilized in conjunction with the identical triangular cantilevers 38, this column arrangement of FIG. 14*r*** is most conducive to the construction of a totally "modular" building.

In the field, the tower's central area 41 could be erected in conjunction with the entire assemblage of structural columns and beams for all floors. Later, the prefabricated floor members 37 could be lifted, in units of one or more successive levels, and rolled into the respective slots of the tower structure. Each floor level 37 could also be 3-dimensional, including interior partitions, plumbing and electrical chases, and private staircases (in duplex units).

By following this means of erection, a particular virtue of these floor members 37 is the trapezoidal shape. Like pieces of a pie, with the widest dimension at the periphery, each and every floor subdivision could enter and pass between pairs of tower columns 40 and be wedged against adjacent subdivisions—each of whose side edges is supported by a common structural beam.

As a final note for FIG. 15, a third distance "C" is utilized, in addition to the A and B dimensions previously discussed, in order to simplify an understanding of the relative proportions of this particular column arrangement. This is because the specified distance B is equal to $\sqrt{2}$ A, which is the length of either leg of an isosceles right triangle whose hypotenuse equals the distance 2A. In this case, "C" equals the difference between the leg and the hypotenuse, and becomes useful here for dimensioning purposes.

Figure 16:
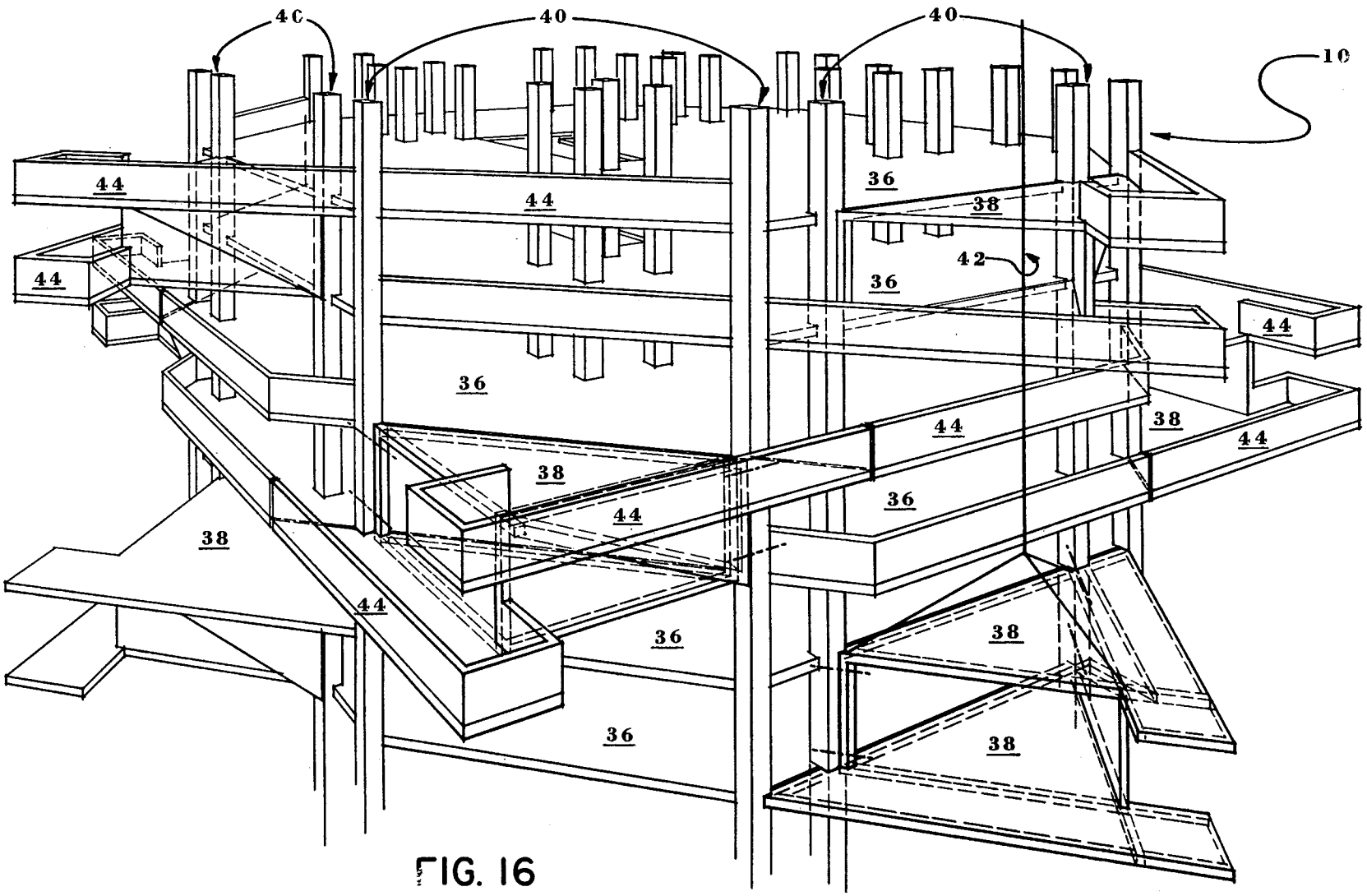
FIG. 16 is a perspective view illustrating how portions of the building of FIG. 1 may be constructed.

Referring to FIG. 16, a perspective view of the on-site construction of building 10 shows the octagonally-shaped floor members 36 of the tower's main structure, and various construction phases of the in-place application and erection of the self-supportive triangular cantilevers. As illustrated in FIGS. 8–11, each triangular cantilever is comprised of two identical floor members 38 (i.e., the top is the flipped-over reverse of the bottom) which, when combined to form a single structural unit, can be lifted by mechanical means 42 and attached into place directly on pairs of structural columns 40. Parapet walls 44 may then be applied on the periphery of the tower's main floors (where applicable), as well as on selected edges of each separate floor member of the triangular cantilevers. In this way, a continuity of form is established between the cantilevers and the tower's main structure. Furthermore, these completed cantilevers serve as functional as well as architectural extensions of two successive floors of the tower's main structure, but are erected by means similar to the application of a "curtain-wall" onto the facade of a conventionally constructed high-rise building.

In relation to the functioning of the enclosed spaces within the tower's main structure (see FIGS. 3–6) each separate floor level of the triangular cantilever is meant to serve a different purpose. Between the upper and lower triangulations of the cantilevered unit, the area 38 defined herein serves as an extension of the enclosed (habitable) space of the tower. Thus, in reference to FIG. 17, the lower projection 39 may function as a private balcony which is directly adjacent to this enclosed space. On the upper level of the cantilevered unit, the floor area 38 is open and may serve as a private or communal terrace. Hence, the upper level projection 39 may function as a planting area.

Figure 18:
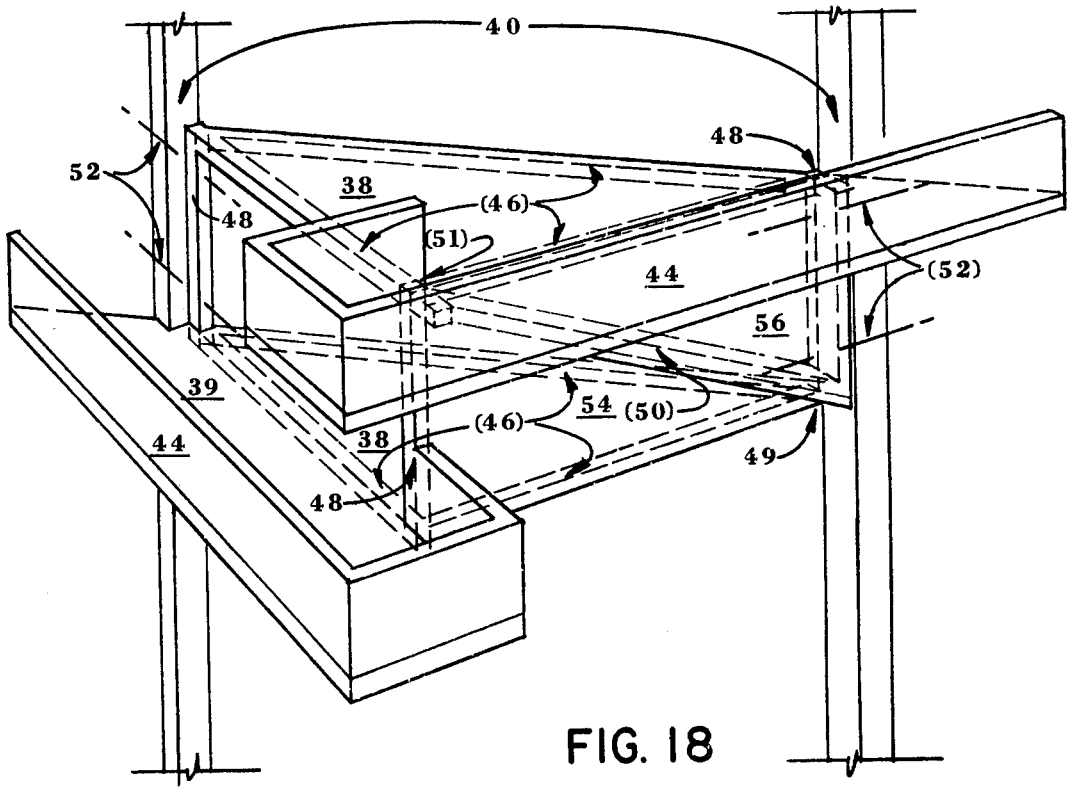
FIG. 18 is a perspective view showing the structural components of a triangular cantilever which is used in the building of FIG. 1.

FIG. 18 is a perspective view of the triangular cantilever, showing its attachment to a pair of tower columns 40. Diagrammatically, the basic structural components of the cantilevered unit are illustrated as a series of dotted lines superimposed over the perspective drawing. In combination, these components resemble a 3-dimensional box-type frame with a cantilever truss (like a "shelf-bracket") located on one side. The fundamental structure is comprised of two triangular frames 46 arranged in parallel and spaced apart the distance of two successive building floors, vertical support members 48 connecting the corners of each separate frame, and a support member 50 diagonally connecting a lower corner 49 adjacent to the building with the outer extremity 51 of the upper frame. As a unit, this basic structure can be site-assembled, lifted, and attached in place to the building columns by connecting means at the points 52. At any stage of its fabrication, the structure may incorporate the floor members 38, the floor projections 39, and the parapet walls 44. Walls 54 and 56 enclosing the trussed side of the unit may also be added.

Figure 17:
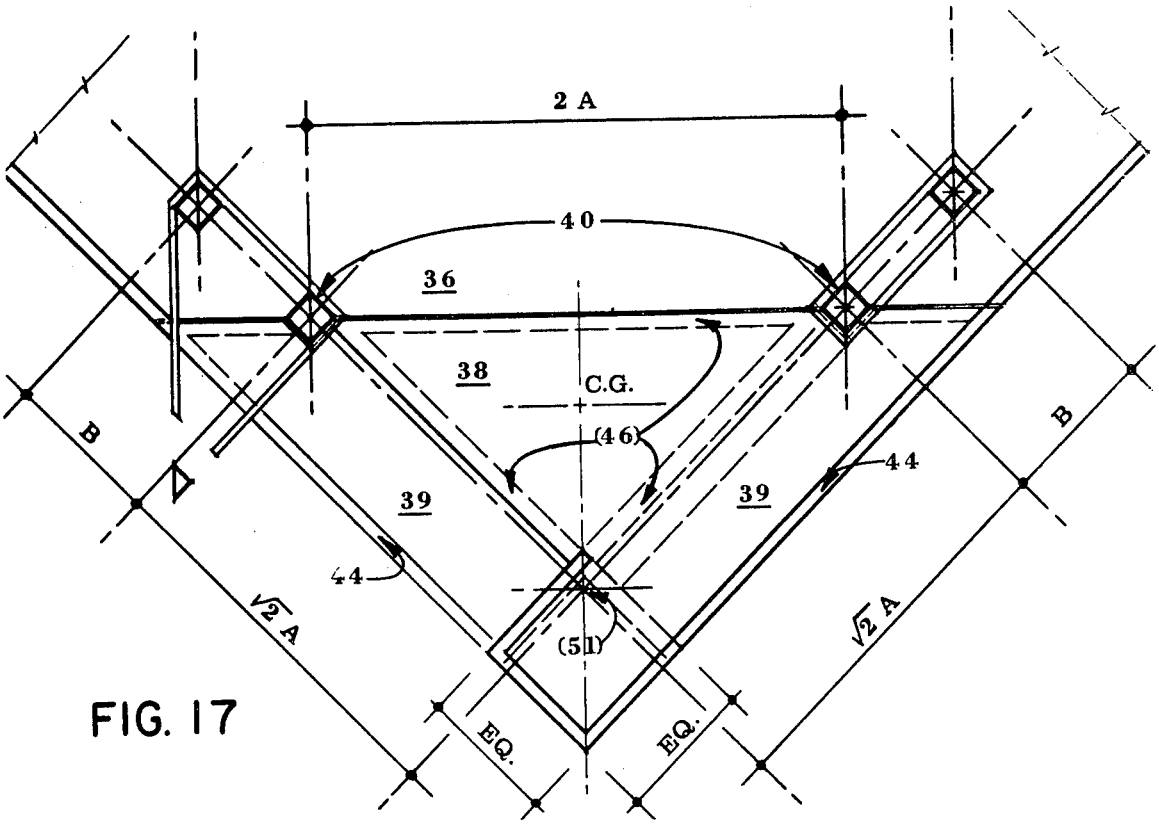
FIG. 17 is a plan view of a triangularly shaped balcony employed in the building of FIG. 1.

The triangular cantilever described in FIGS. 17 and 18 and used extensively in the building of FIG. 1 not only establishes a dramatic functional and aesthetic form-profile for the garden apartment tower, but also its geometric advantage is an engineering "bonanza" in relation to its architectural effect. When viewed perpendicular to the direction of either of its two exposed sides, it achieves a maximum "apparent" cantilever (or unsupported distance) at a minimum structural cost. This is because its center of gravity ("C.G.," in FIG. 17) is located very close to the building line from which it is projected. In fact, in an isosceles right triangle the center of gravity is located, from the hypotenuse, $\frac{5}{8}$ the distance of the altitude, drawn from the midpoint of the hypotenuse to the apex of the other two sides. In a square or rectangular building projection of the same floor area and weight, the center of gravity would be located $\frac{1}{2}$ the distance of the projection. Hence, for identical projections the center of gravity of the triangle is 1/6 closer to the building, whereas its apparent cantilevered projection is greater than that of a square by a factor $\sqrt{2}$. As a mass-unit, its bending-moment force (which may be approximately calculated as a mass or weight acting at its center of gravity) is less, and consequently its basic structural components can be smaller in size than those required to resist the bending-moment force of a comparable square or rectangular building projection.

Figure 19A:
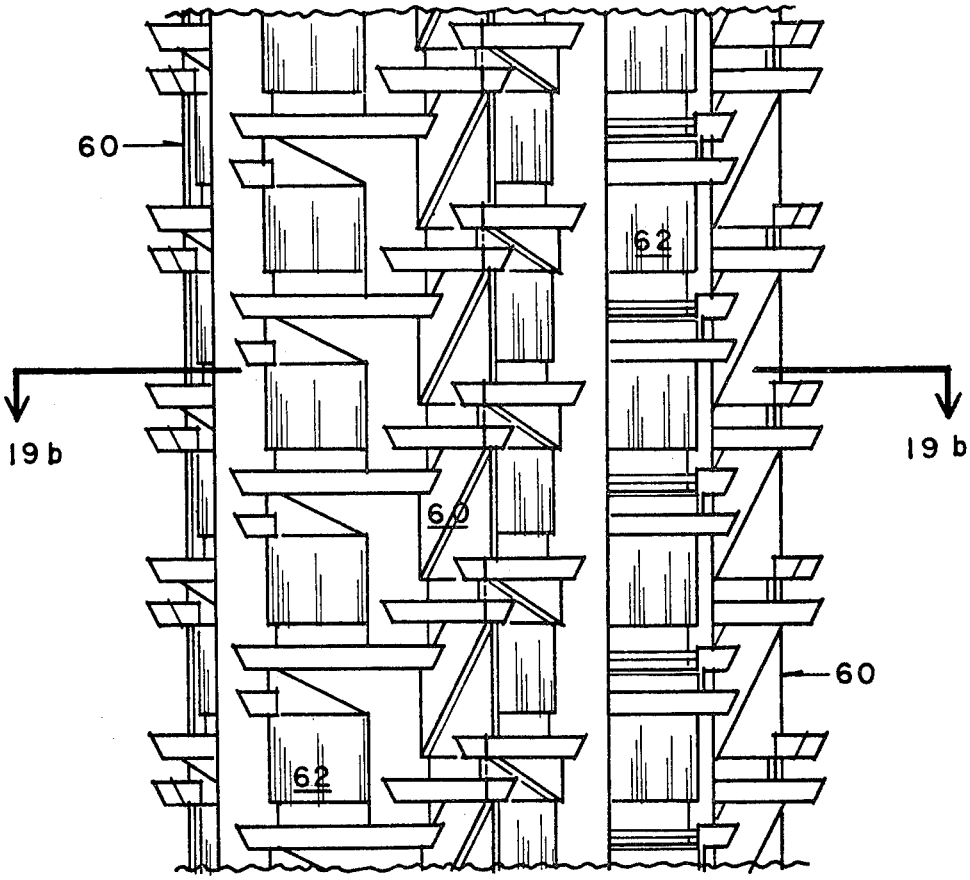
FIGS. 19–21 are elevation and plan views illustrating various applications of the triangular cantilever in relation to simplex apartment (or condominium), hotel and office building towers, respectively.
Figure 19B:
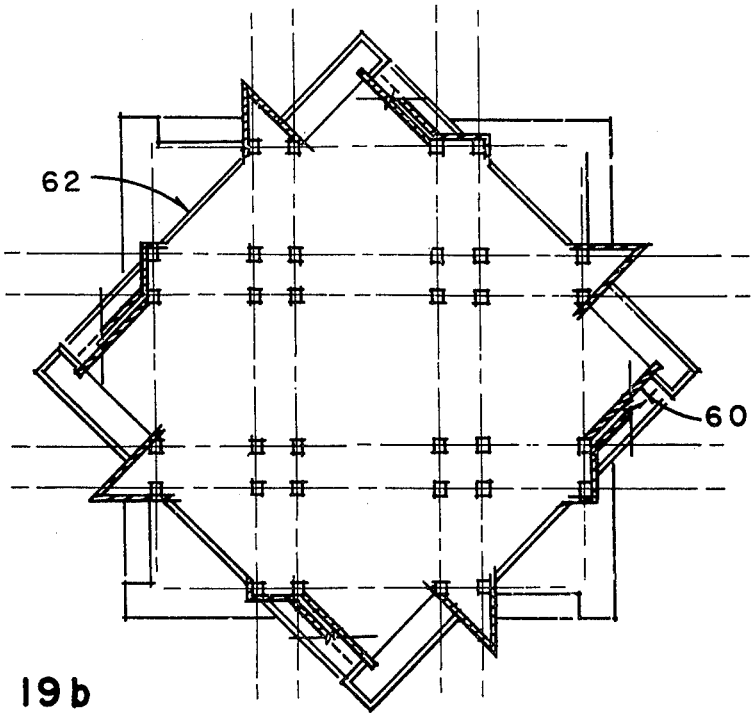
Figure 20A:
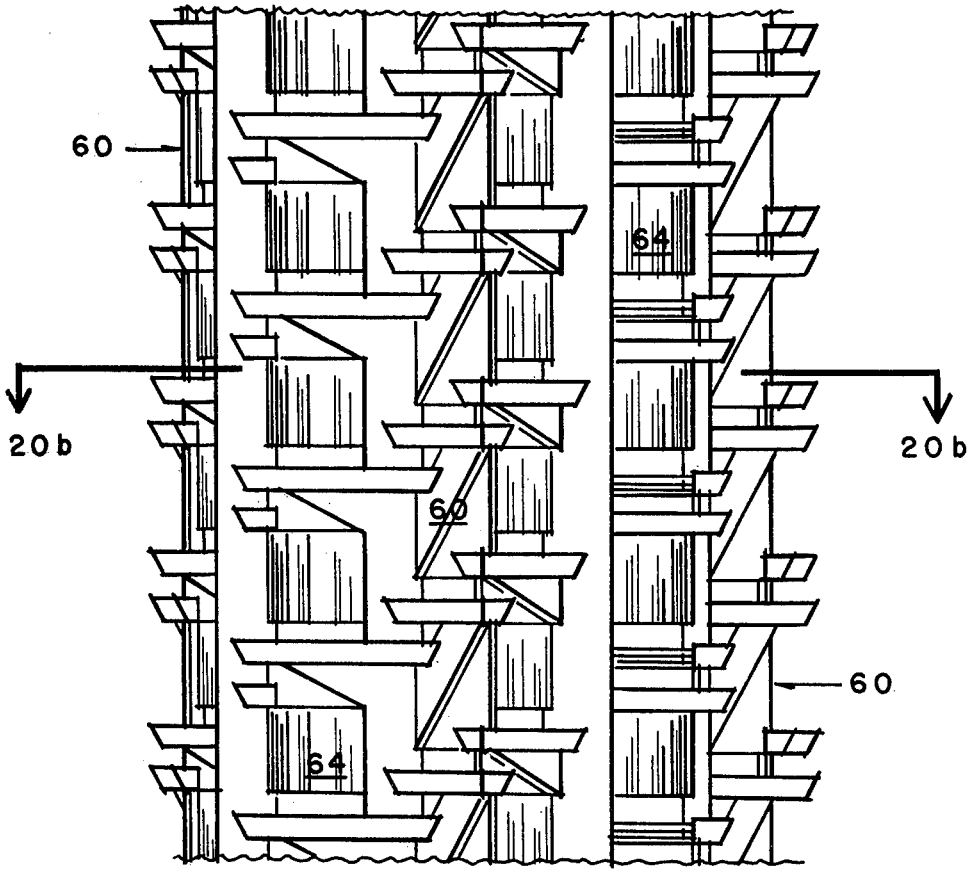
Figure 20B:
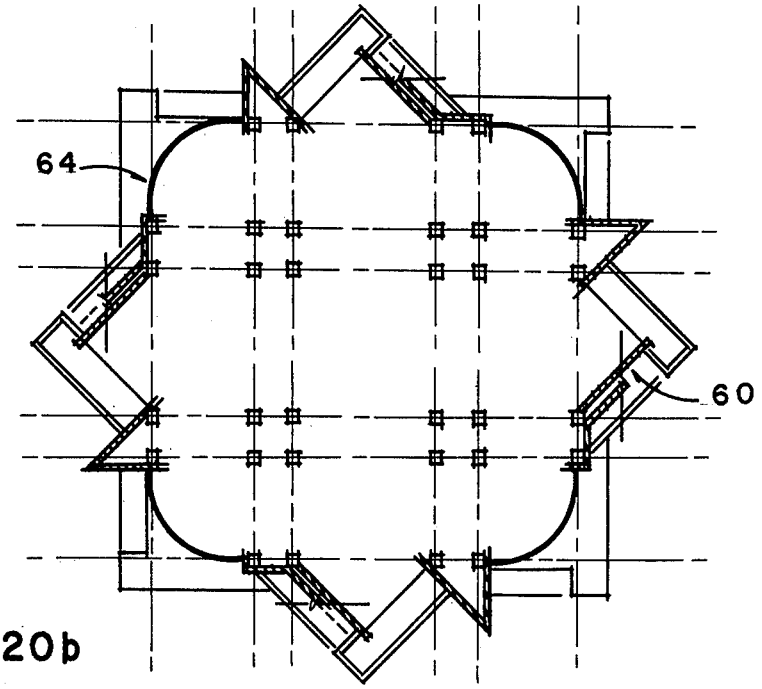
Figure 21A:
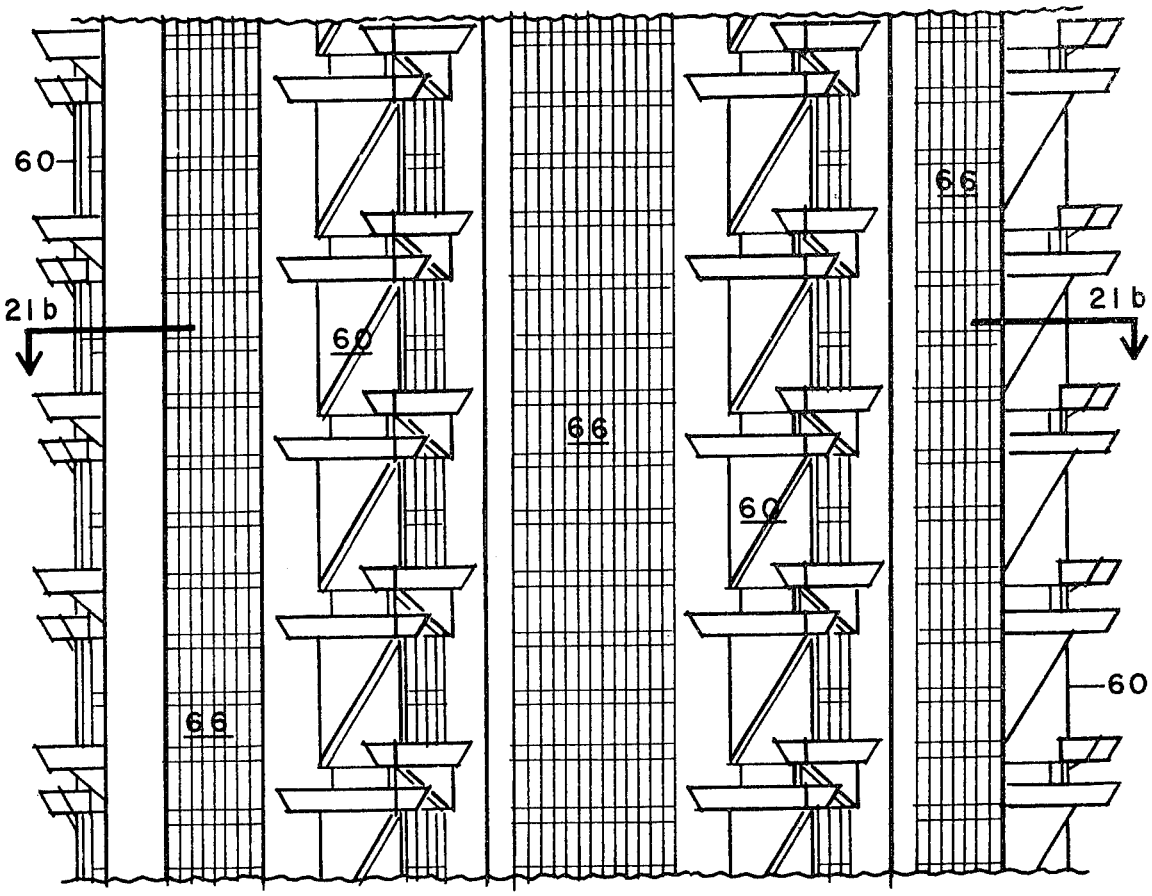
Figure 21B:
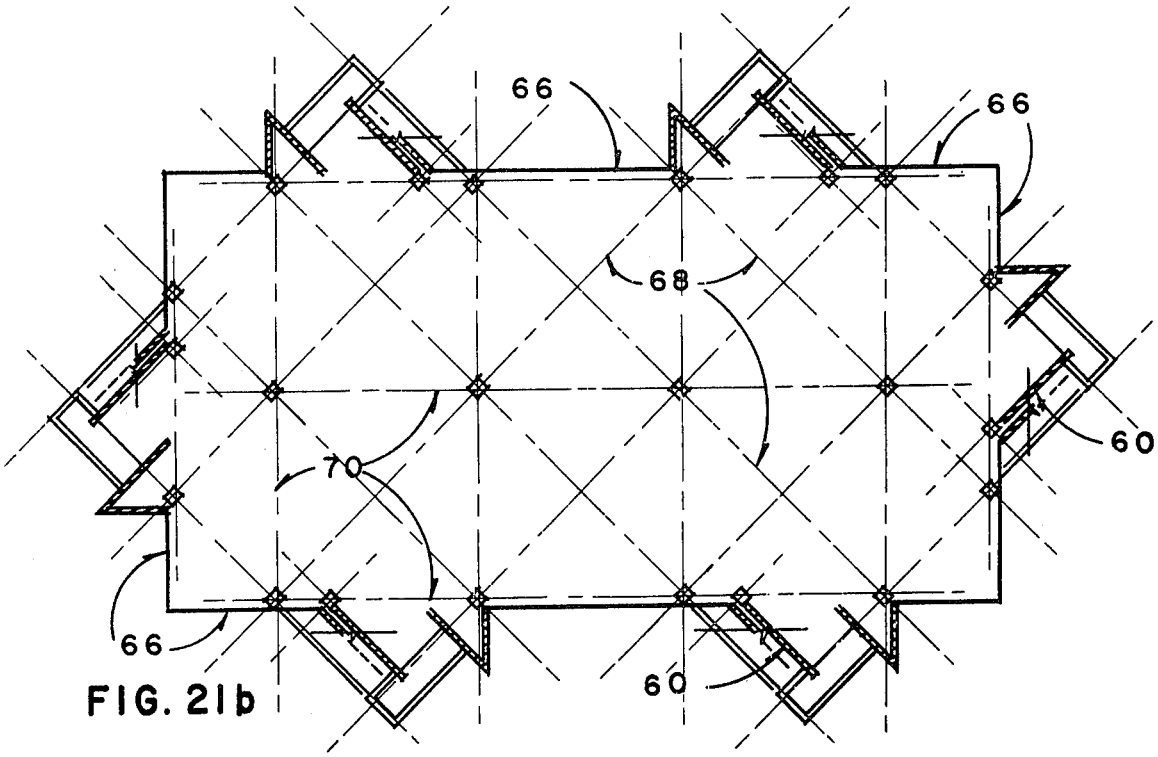

Referring to FIGS. 19–21, it can be seen that the structural advantages of the triangular cantilever are not restricted to the specific configuration as shown in the building of FIG. 1. While the fundamental (two-floor) cantilever may remain unchanged in relation to the basic tower structure, various intermittent floor extensions may assume a variety of shapes either dependent or independent of the fundamental cantilever. Thus, the elevation and plan views of FIGS. 19–21 illustrate such modifications in the form of simplex apartment (or condominium), hotel and office building towers, respectively.

It should be noted that a common modification of the triangular cantilever in each of these particular drawings is the intermittent 4-story cantilevered unit 60, which forms a continuity of enclosed space extending substantially the entire length of each overall building type, along the axii of one of the two structural grid systems established by bisectional design. It should also be noted that the specific location of each plan view (of FIGS. **19*b*, 20*b*, & 21*b*) is indicated by two horizontal lines on each respective elevation (of FIGS. 19*a*, 20*a*, & 21*a***), with arrows pointing in the direction of the view.

In the simplex apartment (or condominium) tower of FIGS. **19*a* and 19*b*, in addition to the intermittent 4-story triangular cantilevers along one axial system, a flat facade of extended floors 62 may be projected or hung in between the fundamental cantilevers of the other axial system. In the hotel as shown in FIGS. 20*a* and 20*b*, a rounded facade of extended floors 64** may be projected or hung in between these fundamental cantilevers.

Referring to FIGS. **21*a* and 21*b*, another variation of the triangular cantilever is indicated as it may be applied (through bisectional design) to an office building structure. In this particular case, two basically square tower structures are combined into one rectangular-shaped building. The basic facade of the rectangular building is herein shown as a flat, conventional curtain-wall system 66, following the axii of one structural grid system 70. The fundamental and intermittent cantilevers are shown projecting from this facade, thus providing additional rentable space along a second axial grid system 68**.

By utilizing the same cantilevered proportions as heretofore mentioned throughout, these projected units mate a pattern of four residential floors at 9 ft. each (i.e. "vertical module") to three office floors at 12 ft. each, both equalling 36 ft. (or structurally synchronizing every 36 ft. vertically). Hence, the architectural expression of this office building can be scaled in close coordination to an adjoining residential development. Furthermore, it can be seen in the plan view of FIG. **21*b* that certain columns have been omitted from the intersecting lines of the grid system 68 which is diagonal to the rectangular building shape, thus establishing longer structural spans. This is in keeping with the economics of office building construction where if, for example, the diagonal grid 68 is primarily set up for residential construction with an overall grid spacing of 30 ft., by utilizing the hypotenuse of a 30 ft. square grid, the office construction can be set up at 42.5 ft. spans utilizing structural grid 70**. Within a continuous megastructural complex, this design principle establishes office building potential aligned at a 45° angle to all primary residential construction.

Figure 22:
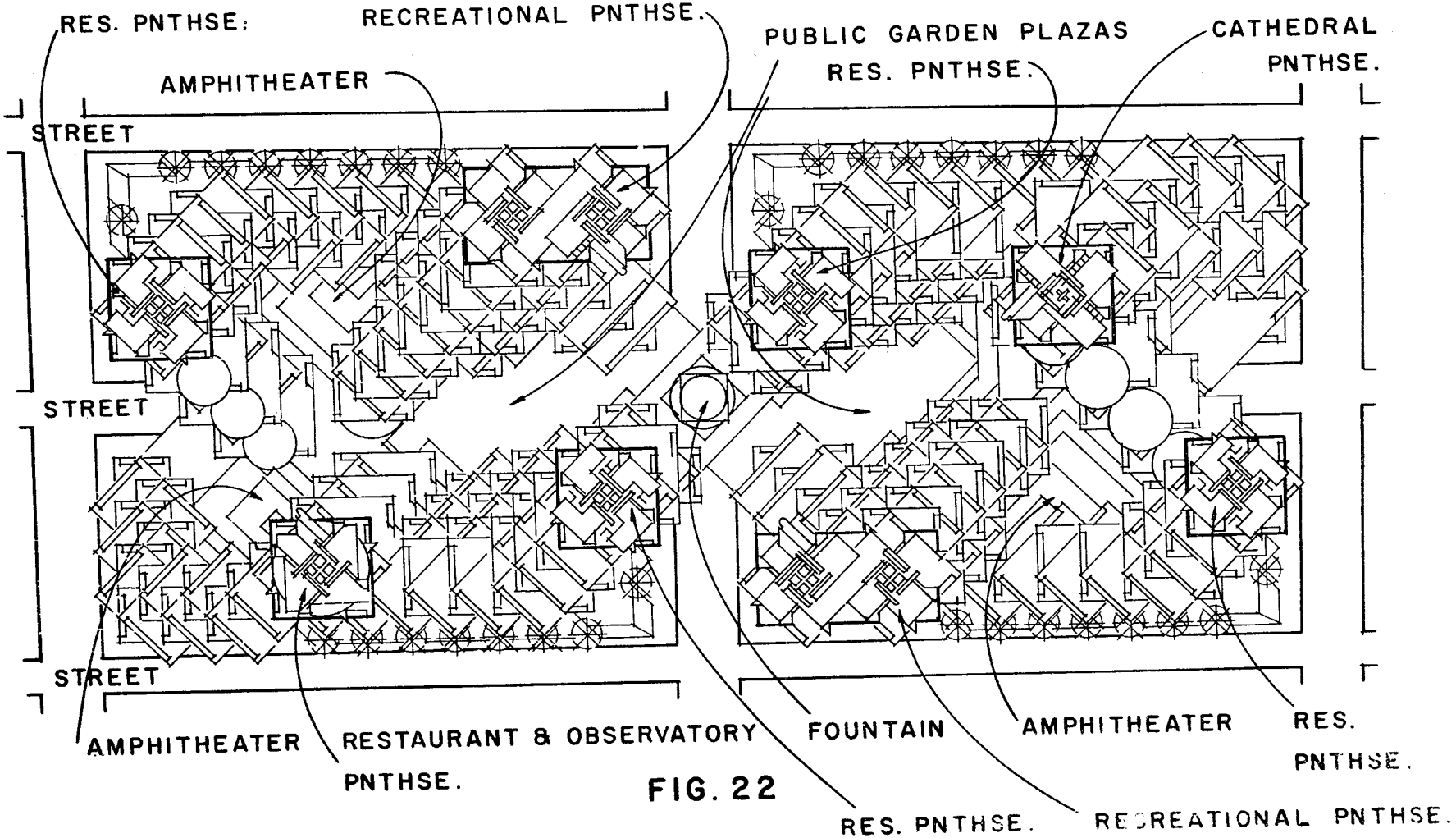
FIG. 22 is an aerial plan view of four hypothetical city blocks in Manhatten, utilizing the principles of bisectional design throughout.

In FIG. 22, a hypothetical pilot project for Manhattan shows the application of bisectional design in a four city-block area. It can be observed that the basic megastructure is comprised of two separate grid systems: one parallel and perpendicular to the street and sidewalk grid system; the other oriented at a 45° angle (or diagonal) with the first. Each separate grid system is articulated by respective triangular cantilevers, and office buildings are substantially oriented in accordance with the grid system parallel and perpendicular to the street. Other various tower structures are situated in relation to elevated plazas, open atrium courts, and spacious amphitheaters, and all rooftops are landscaped and treated with special functions.

Thus, in this illustration of a bisectional megastructure within the heart of a high-density urban area, it can be seen that immense form freedom is achieved in uniform accordance with the points of coincidence of the two bisecting grid systems. This facilitates the use of identical triangular cantilevers, as well as many other identical structural components throughout. This major economic advantage is made possible through a selective vertical column arrangement which facilitates such standardization, regardless of orientation. Through such flexibility, old or existing buildings can be incorporated within the overall megastructural complex, in a highly practical and realistic way. A wide variety of urban properties can thus become integrated into a larger "one," greater than the sum of its individual parts, by complimentary interaction. That is precisely what cities are intended to achieve.

Although the present invention has been described with reference to specific embodiments thereof, many modifications and variations of such embodiments may be made by those skilled in the art without departing from the inventive concepts disclosed. Accordingly, all such modifications and variations are intended to be included within the spirit and scope of the appended claims.

I claim:

1. A multi-level building construction including prefabricated self-supporting triangular dual floor cantilever units attached to and cantilevered from a side of said building construction, thereby extending the floor space of two floors of the building, each unit comprising in combination:

(a) a first substantially triangular planar floor member having a first side edge, called a base edge, and second and third side edges, called lateral edges;

(b) a second substantially triangular planar floor member having a first side edge, called a base edge, and second and third side edges, called lateral edges, said second floor member being arranged above and parallel to said first floor member with the base edges of the two floor members in a common vertical plane;

(c) a first support member, extending diagonally from a point substantially at the base edge of one of said first and second floor members to a point substantially at the apex of the lateral edges of the other of said first and second floor members; and (d) a second support member, extending substantially vertically downward from a point substantially at the apex of the lateral edges of said second floor member to a point substantially at the apex of the lateral edges of said first floor member;

(e) said cantilevered units being attached into place directly on pairs of structural column supports forming a part of said building construction;

whereby the units are prefabricated on the ground and lifted and attached to said building.

2. The triangular cantilever defined in claim 1, wherein said first support member extends diagonally upward from a point substantially at the base edge of said first floor member to a point substantially at the apex of the lateral edges of said second floor member.

3. The triangular cantilever defined in claim 2, wherein said first support member includes a wall extending substantially vertically upward to said second floor member from a line extending upward from a point substantially at the base edge of said first floor member to a point substantially at the apex of the lateral edges of said second floor member.

4. The triangular cantilever defined in claim 1, wherein said first support member extends diagonally downward from a point substantially at the base edge of said second floor member to a point substantially at the apex of the lateral edges of said first floor member.

5. The triangular cantilever defined in claim 4, wherein said first support member includes a wall extending substantially vertically downward to said first floor member from a line extending downward from a point substantially at the base edge of said second floor member to a point substantially at the apex of the lateral edges of said first floor member.

6. The triangular cantilever defined in claim 1, wherein said second and third side edges of said first and second floor members are of substantially equal length, whereby said floor members form substantially isosceles triangles.

7. The triangular cantilever defined in claim 1, wherein all of said side edges of said first and second floor members are of substantially equal length, whereby said floor members form substantially equilateral triangles.

8. The triangular cantilever defined in claim 1, wherein the extremity of said first support member at said point substantially at said base edge is situated at a corner of said one floor member.

9. The triangular cantilever defined in claim 1, further comprising a third support member extending between the base edges of said first and second floor members for maintaining said base edges in parallel a given distance apart.

10. The triangular cantilever defined in claim 9, wherein said third support member includes a substantially vertical column arranged between said first and second floor members at each corner of the base edges thereof.

11. The triangular cantilever defined in claim 9, wherein said third support member is detachable from said first and second floor members, whereby said triangular cantilever may be hoisted into position on an architectural structure with said third support member maintaining the structural rigidity thereof and, after attachment to the architectural structure, the third support member may be removed.

12. The triangular cantilever defined in claim 1, further comprising a parapet wall arranged along at least one lateral edge of at least one floor member, said parapet wall extending from the base edge of said at least one floor member to a point beyond the apex of said lateral edges thereof.

13. The triangular cantilever defined in claim 1 wherein said first and second triangular planar floor members form substantially "right" triangular shapes with a 90° angle between said lateral edges.

14. The triangular cantilever defined in claim 1 wherein said first and second triangular planar floor members incorporate identical cantilever floor projections along opposing ones of said lateral edges so that each separate planar floor member is identical only as the "flipped-over" reverse of the other.

* * * * *

UNITED STATES PATENT AND TRADEMARK OFFICE

CERTIFICATE OF CORRECTION

PATENT NO. : 4,098,039

DATED : July 4, 1978

INVENTOR(S) : Franklin S. Sutelan

It is certified that error appears in the above-identified patent and that said Letters Patent are hereby corrected as shown below:

Front page, Item 76, "301 E. 53rd #3A, New York, N.Y. 10022" should read --610 West Princess Anne Road, Apt. B-3, Norfolk, Virginia 23517--;

Front page, ABSTRACT, between the first and second paragraphs, insert the following paragraph:

--The bisectional architectural structure is supported by a plurality of columns arranged at the intersecting points of a number of square grids in a horizontal plane. These grids define the distances between adjacent columns and establish a spacial framework within which to erect other buildings or structures.--.

Front page, ABSTRACT, 7th-from-bottom line, "support" should read --supporting--.

UNITED STATES PATENT AND TRADEMARK OFFICE

CERTIFICATE OF CORRECTION

PATENT NO. : 4,098,039

DATED : July 4, 1978

INVENTOR(S) : Franklin S. Sutelan

It is certified that error appears in the above-identified patent and that said Letters Patent are hereby corrected as shown below:

Col. 5, line 48, before "bedrooms" delete "=".

Col. 5, line 55, "per BR)." should follow "1.5 persons".

Col. 8, line 7, "illustrated" should read --illustration--.

Col. 8, line 25, should be indented;

Col. 9, following line 53, insert the following paragraph:

--It should be noted that structural characteristics of floor members 38 may provide a self-sufficient "frame-action" which eliminates the necessity for the structural components 46.--

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*